US011911665B2

(12) United States Patent
Watanabe et al.

(10) Patent No.: US 11,911,665 B2
(45) **Date of Patent: *Feb. 27, 2024**

(54) GOLF BALL

(71) Applicant: BRIDGESTONE SPORTS CO., LTD., Tokyo (JP)

(72) Inventors: Hideo Watanabe, Saitamaken (JP); Atsuki Kasashima, Saitamaken (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 6 days.

This patent is subject to a terminal disclaimer.

(21) Appl. No.: 17/743,574

(22) Filed: May 13, 2022

(65) Prior Publication Data

US 2022/0370859 A1 Nov. 24, 2022

(30) Foreign Application Priority Data

May 24, 2021 (JP) ..... 2021-087080

(51) Int. Cl.
*A63B 37/06* (2006.01)
*A63B 37/00* (2006.01)

(52) U.S. Cl.
CPC ..... *A63B 37/0074* (2013.01); *A63B 37/0021* (2013.01); *A63B 37/00215* (2020.08); *A63B 37/0063* (2013.01); *A63B 37/0064* (2013.01); *A63B 37/0065* (2013.01); *A63B 37/008* (2013.01); *A63B 37/0087* (2013.01)

(58) Field of Classification Search
CPC ..... A63B 37/0062; A63B 37/0063
USPC ..... 473/373
See application file for complete search history.

(56) References Cited

U.S. PATENT DOCUMENTS

| | | | | |
|---|---|---|---|---|
| 5,273,287 | A | 12/1993 | Molitor et al. | |
| 5,470,075 | A | 11/1995 | Nesbitt et al. | |
| 5,507,493 | A | 4/1996 | Sullivan et al. | |
| 5,601,503 | A | 2/1997 | Yamagishi et al. | |
| 5,738,597 | A | 4/1998 | Sullivan et al. | |
| 11,642,572 | B2 * | 5/2023 | Watanabe ..... | A63B 37/0063 473/351 |
| 11,642,573 | B2 * | 5/2023 | Watanabe ..... | A63B 37/0092 473/377 |
| 2004/0043835 | A1 | 3/2004 | Endo et al. | |

(Continued)

FOREIGN PATENT DOCUMENTS

| | | | |
|---|---|---|---|
| JP | 04-371170 | A | 12/1992 |
| JP | 06-114123 | A | 4/1994 |

(Continued)

*Primary Examiner* — Raeann Gorden
(74) *Attorney, Agent, or Firm* — Sughrue Mion, PLLC

(57) ABSTRACT

In a golf ball having a core and a cover with a plurality of dimples on the surface, the cover is formed primarily of polyurethane, the dimples have a specific volume occupancy ratio and the ball has a diameter of at least 42.8 mm. In an impact test carried out by hitting the ball with a driver at a head speed of 40 m/s, the sum t1+t2 of the time t1 required from initial contact by the driver with the ball for deformation of the ball to reach a maximum and the time t2 required from the state of maximum ball deformation for the ball and driver to separate is 660 μsec or less. This golf ball makes it possible for golfers who have a high head speed and ordinary golfers who do not to compete without relying excessively on superiority in terms of distance.

10 Claims, 4 Drawing Sheets

(56) References Cited

U.S. PATENT DOCUMENTS

| | | | | |
|---|---|---|---|---|
| 2006/0035724 | A1 | 2/2006 | Watanabe | |
| 2015/0065268 | A1* | 3/2015 | Nakajima | A63B 37/0065 473/376 |
| 2016/0175660 | A1* | 6/2016 | Watanabe | A63B 37/0087 473/374 |
| 2019/0151719 | A1 | 5/2019 | Sullivan et al. | |
| 2019/0381362 | A1 | 12/2019 | Madson et al. | |
| 2020/0114211 | A1 | 4/2020 | Madson et al. | |
| 2020/0114212 | A1 | 4/2020 | Madson et al. | |

FOREIGN PATENT DOCUMENTS

| | | | |
|---|---|---|---|
| JP | 08-238335 | A | 9/1996 |
| JP | 10-211301 | A | 8/1998 |
| JP | 2002-529162 | A | 9/2002 |
| JP | 2004-089544 | A | 3/2004 |
| JP | 2006-055638 | A | 3/2006 |
| WO | 00/27480 | A1 | 5/2000 |

* cited by examiner

GOLF BALL

CROSS-REFERENCE TO RELATED APPLICATION

This non-provisional application claims priority under 35 U.S.C. § 119(a) on Patent Application No. 2021-087080 filed in Japan on May 24, 2021, the entire contents of which are hereby incorporated by reference.

TECHNICAL FIELD

The present invention relates to a golf ball of two or more pieces that has at least a core and a cover, which cover has a plurality of dimples on the surface thereof.

BACKGROUND ART

A variety of golf balls designed to increase distance and provide a good feel at impact have hitherto been described. Most such golf balls, even if optimized for golfers who have a head speed of about 45 m/s, are unsatisfactory in terms of distance, feel and the like when used by golfers having a head speed of about 40 m/s. Those golf balls which have been optimized for golfers having a head speed of about 40 m/s often do not stop easily on the green on shots with an iron and pose problems in the short game. Golf ought to be a game in which the players compete based on skill. When the differences in distance that arise from disparities in the head speeds of golfers are too large, the players end up competing based largely on power, which is hardly ideal.

Design modifications hitherto made in golf balls with a construction of two or more pieces having a core and a cover include making the ball diameter larger than normal and adjusting the total volume of the dimples. Examples of such literature include JP-A H04-371170, JP-A H06-114123, JP-A H08-238335, JP-A H10-211301, JP-A 2002-529162, JP-A 2004-089544, JP-A 2006-055638, U.S. Pat. Nos. 5,470,075 and 5,507,493, U.S. Published Patent Application No. 2019/0151719, U.S. Published Patent Application No. 2019/0381362, U.S. Published Patent Application No. 2020/0114211 and U.S. Published Patent Application No. 2020/0114212.

However, these prior-art golf balls are balls for which, on shots with a driver (W #1), the distance difference between golfers who have a high head speed and golfers who do not is large enough that, when playing with the same ball, the lower head speed golfer who has less power is at a disadvantage, or are balls which are unacceptable for competing on score based on the golfer's shot accuracy and technique on approach shots. Also, to compete on score without relying on power, that is, based on the skill of the golfer on each shot, it is surely fair and desirable to increase the spin rate in the short game and thereby enhance controllability without increasing the run, i.e., the difference between the total distance and the carry, on iron shots. Accordingly, there has existed a need to develop a golf ball which is fair and appropriate for each of the above target players while complying with the basic Rules of Golf.

SUMMARY OF THE INVENTION

It is therefore an object of the present invention to provide a golf ball which, when the same ball is used by a golfer who has a high head speed and a golfer who does not, enables a fair and appropriate competition using identical balls that is based upon the skill of the golfers on iron shots and in the short game instead of relying excessively on superiority in terms of distance.

As a result of intensive investigations, we have discovered that, in a golf ball having a core and a cover, by forming the cover primarily of polyurethane, setting the volume occupancy ratio VR of the plurality of dimples formed on the cover within the range of 0.80 to 0.92% and moreover designing the ball so as to have a diameter of at least 42.8 mm and such that, in an impact test carried out by hitting the ball with a driver at a head speed of 40 m/s, the sum t1+t2 of the time t1 required from initial contact by the driver with the ball for deformation of the ball to reach a maximum and the time t2 required from the state of maximum ball deformation for the ball and driver to separate is 660 μsec or less, the distance difference between a golfer who has a high head speed and a golfer who does not when the ball is hit with a driver (W #1) is not excessively large, the run on iron shots is not long and the spin rate of the ball in the short game is high, enabling a golf ball of good controllability to be provided.

As used herein, a "golfer who has a high head speed" refers to a player whose head speed (HS) is 45 m/s or more, and a "golfer who does not [have a high head speed]" refers to a player whose head speed is less than 45 m/s.

Accordingly, the invention provides a golf ball having a core and a cover, which cover has a plurality of dimples on a surface thereof, wherein the cover is formed primarily of polyurethane and the dimples thereon have a volume occupancy ratio VR within the range of 0.80 to 0.92%, the ball has a diameter of at least 42.8 mm and, in an impact test carried out by hitting the ball with a driver at a head speed of 40 m/s, the sum t1+t2 of the time t1 required from initial contact by the driver with the ball for deformation of the ball to reach a maximum and the time t2 required from the state of maximum ball deformation for the ball and the driver to separate is 660 μsec or less.

In a preferred embodiment of the golf ball of the invention, the time t1 and the time t2 have a ratio t2/t1 therebetween which is 1.28 or less.

In another preferred embodiment of the inventive golf ball, the ball has a deflection of 3.2 mm or less when compressed under a final load of 1,275 N (130 kgf) from an initial load of 98 N (10 kgf).

In yet another preferred embodiment, the core has a diameter of at least 37.0 mm and a hardness profile in which, letting Cc be the Shore C hardness at a center of the core, Cs be the Shore C hardness at a surface of the core, Cm be the Shore C hardness at a midpoint M between the core center and the core surface, Cm−2, Cm−4, Cm−6 and Cm−8 be the respective Shore C hardnesses at positions 2 mm, 4 mm, 6 mm and 8 mm inward from the midpoint M and Cm+2, Cm+4 and Cm+6 be the respective Shore C hardnesses at positions 2 mm, 4 mm and 6 mm outward from the midpoint M, and defining surface areas X and A to F as follows surface area X: ½×2×(Cm−6-Cm−8)
surface area A: ½×2×(Cm−4-Cm−6)
surface area B: ½×2×(Cm−2-Cm−4)
surface area C: ½×2×(Cm-Cm−2)
surface area D: ½×2×(Cm+2-Cm)
surface area E: ½×2×(Cm+4-Cm+2)
surface area F: ½×2×(Cm+6-Cm+4), the core satisfies the condition:

$$(\text{surface area } D+\text{surface area } E+\text{surface area } F)-(\text{surface area } A+\text{surface area } B+\text{surface area } C)>0.$$

In the foregoing embodiment, the core may satisfy the condition:

$$(\text{surface area } D+\text{surface area } E+\text{surface area } F)-(\text{surface area } X+\text{surface area } A+\text{surface area } B+\text{surface area } C)>0.$$

In the same embodiment, the core may satisfy the condition:

$$(\text{surface area } D+\text{surface area } E)-(\text{surface area } A+\text{surface area } B+\text{surface area } C)\geq 1.$$

In the same embodiment, the core may satisfy the condition:

$$(\text{surface area } D+\text{surface area } E)-(\text{surface area } X+\text{surface area } A+\text{surface area } B+\text{surface area } C)>0.$$

In the same embodiment, the core may satisfy the condition:

$$0<[(\text{surface areas } D+E+F)-(\text{surface areas } A+B+,C)]/(Cs-Cc)\leq 1.00.$$

In the same embodiment, the value expressed as Cs−Cc may be 20 or more.

In another preferred embodiment of the inventive golf ball, letting E (mm) be the deflection of the core when compressed under a final load of 1,275 N (130 kgf) from an initial load of 98 N (10 kgf) and B (mm) be the deflection of the ball when compressed under a final load of 1,275 N (130 kgt) from an initial load of 98 N (10 kgt), the value E−B (mm) is from 0.3 to 1.2 mm.

Advantageous Effects of the Invention

The golf ball of the invention reduces excessive disparities in distance arising from the relative head speeds of golfers on shots with a driver (W #1), shortens the run on full shots with an iron, and is highly receptive to spin in the short game, resulting in a high controllability. Another advantageous effect of the inventive golf ball is that, particularly on full shots taken with a driver (W #1) or an iron by a golfer whose head speed (HS) is not fast, the distance traveled by the ball is not too small.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
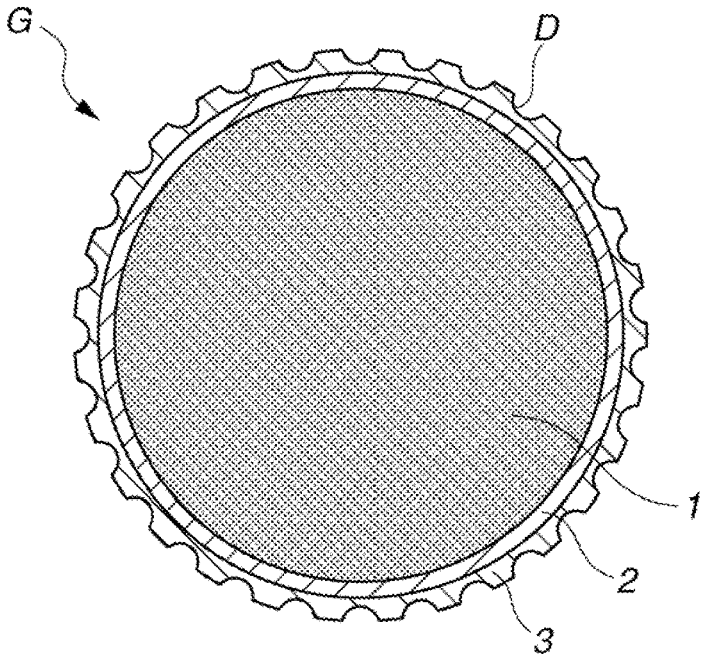
FIG. 1 is a schematic cross-sectional view of the golf ball according to one embodiment of the invention.

The golf ball of the invention has a core and a cover. One or more intermediate layer may be interposed between the core and the cover. For example, FIG. 1 shows a golf ball G having a three-piece construction that includes a core 1, an intermediate layer 2 encasing the core 1, and a cover 3 encasing the intermediate layer 2. The cover 3 is positioned as the outermost layer, excluding a coating layer, in the layered construction of the ball. Numerous dimples D are typically formed on the surface of the cover (outermost layer) 3 to enhance the aerodynamic properties of the ball. Although not shown in FIG. 1, a coating layer is generally formed on the surface of the cover 3. Each layer is described in detail below.

The core is composed primarily of a rubber material. Specifically, a core-forming rubber composition can be prepared by using a base rubber as the chief component and including together with this other ingredients such as a co-crosslinking agent, an organic peroxide, an inert filler and an organosulfur compound. It is preferable to use polybutadiene as the base rubber.

Commercial products may be used as the polybutadiene. Illustrative examples include BR01, BR51 and BR730 (from JSR Corporation). The proportion of polybutadiene within the base rubber is preferably at least 60 wt %, and more preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and also other diene rubbers, such as styrene-butadiene rubbers, natural rubbers, isoprene rubbers and ethylene-propylene-diene rubbers.

Examples of co-crosslinking agents include unsaturated carboxylic acids and the metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids include, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 20 parts by weight, preferably at least 25 parts by weight, and more preferably at least 30 parts by weight. The amount included is typically not more than 60 parts by weight, preferably not more than 50 parts by weight, and more preferably not more than 40 parts by weight. Too much may make the core too hard, giving the ball an unpleasant feel at impact, whereas too little may lower the rebound.

Commercial products may be used as the organic peroxide. Examples of such products that may be suitably used include Percumyl D, Perhexa C-40 and Perhexa 3M (all from NOF Corporation), and Luperco 231 XL (from AtoChem Co.). One of these may be used alone, or two or more may be used together. The amount of organic peroxide included per 100 parts by weight of the base rubber is preferably at least 0.1 part by weight, more preferably at least 0.3 part by weight, and even more preferably at least 0.5 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a good feel, durability and rebound.

Another compounding ingredient typically included with the base rubber is an inert filler, preferred examples of which include zinc oxide, barium sulfate and calcium carbonate. One of these may be used alone, or two or more may be used together. The amount of inert filler included per 100 parts by weight of the base rubber is preferably at least 1 part by weight, and more preferably at least 2 parts by weight. The upper limit is preferably not more than 20 parts by weight, more preferably not more than 15 parts by weight, and even more preferably not more than 12 parts by weight. Too much or too little inert filler may make it impossible to obtain a proper weight and a suitable rebound.

In addition, an antioxidant may be optionally included. Illustrative examples of suitable commercial antioxidants include Nocrac NS-6 and Nocrac NS-30 (both available from Ouchi Shinko Chemical Industry Co., Ltd.), and Yoshinox 425 (available from Yoshitomi Pharmaceutical Industries, Ltd.). One of these may be used alone, or two or more may be used together.

The amount of antioxidant included per 100 parts by weight of the base rubber is set to preferably 0 part by weight or more, more preferably at least 0.05 part by weight, and even more preferably at least 0.1 part by weight. The upper limit is set to preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable ball rebound and durability.

An organosulfur compound may be included in the core in order to impart a good resilience. The organosulfur compound is not particularly limited, provided that it can enhance the rebound of the golf ball. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol is especially preferred.

It is recommended that the amount of organosulfur compound included per 100 parts by weight of the base rubber be preferably 0 part by weight or more, more preferably at least 0.05 part by weight, and even more preferably at least 0.1 part by weight, and that the upper limit be preferably not more than 5 parts by weight, more preferably not more than 3 parts by weight, and even more preferably not more than 2.5 parts by weight. Including too much organosulfur compound may make a greater rebound-improving effect (particularly on shots with a W #1) unlikely to be obtained, may make the core too soft or may worsen the feel of the ball at impact. On the other hand, including too little may make a rebound-improving effect unlikely.

Decomposition of the organic peroxide within the core formulation can be promoted by the direct addition of water (or a water-containing material) to the core material. The decomposition efficiency of the organic peroxide within the core-forming rubber composition is known to change with temperature; starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of core vulcanization, the vicinity of the core surface remains at substantially the same temperature as the temperature of the vulcanization mold, but the temperature near the core center, due to the build-up of heat of decomposition by the organic peroxide which has decomposed from the outside, becomes considerably higher than the mold temperature. In cases where water (or a water-containing material) is added directly to the core, because the water acts to promote decomposition of the organic peroxide, radical reactions like those described above can be made to differ at the core center and core surface. That is, decomposition of the organic peroxide is further promoted near the center of the core, bringing about greater radical deactivation, which leads to a further decrease in the amount of active radicals. As a result, it is possible to obtain a core in which the crosslink densities at the core center and the core surface differ markedly. It is also possible to obtain a core having different dynamic viscoelastic properties at the core center.

The water included in the core material is not particularly limited, and may be distilled water or tap water. The use of distilled water that is free of impurities is especially preferred. The amount of water included per 100 parts by weight of the base rubber is preferably at least 0.1 part by weight, and more preferably at least 0.3 part by weight. The upper limit is preferably not more than 5 parts by weight, and more preferably not more than 4 parts by weight.

The core can be produced by vulcanizing and curing the rubber composition containing the above ingredients. For example, the core can be produced by using a Banbury mixer, roll mill or other mixing apparatus to intensively mix the rubber composition, subsequently compression molding or injection molding the mixture in a core mold, and curing the resulting molded body by suitably heating it under conditions sufficient to allow the organic peroxide or co-crosslinking agent to act, such as at a temperature of between 100 and 200° C., preferably between 140 and 180° C., for 10 to 40 minutes.

The core may be formed of a single layer or may be formed of a plurality of layers, one example of the latter being a core having a two-layer construction consisting of an inner core layer and an outer core layer. When the core is a two-layer core formed of an inner core layer and an outer core layer, both the inner core layer and the outer core layer may be composed chiefly of the above-described rubber material. The rubber material of the outer core layer which encases the inner core layer may be of the same type as the inner core layer material or may be of a different type. The ingredients therein are similar to those described above for the core-forming rubber composition.

The core has a diameter of preferably at least 37.0 mm, more preferably at least 38.0 mm, and even more preferably at least 39.0 mm. The upper limit is preferably 41.2 mm or less, more preferably 40.3 mm or less, and even more preferably 39.4 mm or less. When the core diameter is too small, the spin rate on shots with a driver (W #1) may rise and golfers who do not have a fast head speed may be unable to achieve the intended distance. On the other hand, when the core diameter is too large, the durability to repeated impact may worsen or the feel of the ball may worsen.

The core has a deflection when compressed under a final load of 1,275 N (130 kgf) from an initial load of 98 N (10 kgf) which, although not particularly limited, is preferably at least 2.5 mm, more preferably at least 2.7 mm, and even more preferably at least 2.9 mm. The upper limit is preferably not more than 3.9 mm, more preferably not more than 3.7 mm, and even more preferably not more than 3.5 mm. When the core deflection is too small, i.e., when the core is too hard, the spin rate of the ball may rise excessively so that not only golfers who have a high head speed but also golfers who do not fail to achieve a good distance, or the feel at impact may be too hard. On the other hand, when the core deflection is too large, i.e., when the core is too soft, the initial speed when the ball is struck may become so low that not only golfers who have a high head speed but also golfers who do not fail to achieve a good distance, the feel at impact may be too soft, or the durability to cracking on repeated impact may worsen.

Next, the hardness profile of the core is described. The core hardness described below refers to the Shore C hardness. This Shore C hardness is the hardness value measured with a Shore C durometer in accordance with ASTM D2240.

The core center hardness Cc, although not particularly limited, may be set to preferably at least 56, more preferably at least 58, and even more preferably at least 60. Although there is no particular upper limit, the core center hardness Cc may be set to preferably not more than 67, more preferably not more than 65, and even more preferably not more than 63. When this value is too large, the feel at impact may become hard or the spin rate on full shots may rise, as a result of which the intended distance may not be attainable. On the other hand, when this value is too small, the rebound may become low, as a result of which the intended distance may not be attainable, or the durability to cracking on repeated impact may worsen. As used herein, the center hardness (Cc) refers to the hardness measured at the center of the cross-section obtained by cutting the core in half through the center.

The hardness Cm−8 at a position 8 mm inward from the position M located midway between the center and surface of the core (also referred to below as the "midpoint M"), although not particularly limited, may be set to preferably at least 56, more preferably at least 58, and even more preferably at least 60. Although there is no particular upper limit, the hardness may be set to preferably not more than 68, more preferably not more than 66, and even more preferably not more than 64.

The hardness Cm−6 at a position 6 nm inward from the midpoint M of the core, although not particularly limited, may be set to preferably at least 57, more preferably at least 59, and even more preferably at least 61. Although there is no particular upper limit, the hardness Cm−6 may be set to preferably not more than 69, more preferably not more than 67, and even more preferably not more than 65.

The hardness Cm−4 at a position 4 mm inward from the position M of the core, although not particularly limited, may be set to preferably at least 59, more preferably at least 61, and even more preferably at least 63. Although there is no particular upper limit, the hardness Cm−4 may be set to preferably not more than 70, more preferably not more than 68, and even more preferably not more than 66.

The hardness Cm−2 at a position 2 mm inward from the midpoint M of the core, although not particularly limited, may be set to preferably at least 60, more preferably at least 62, and even more preferably at least 64. Although there is no particular upper limit, the hardness Cm−2 may be set to preferably not more than 71, more preferably not more than 69, and even more preferably not more than 67. Hardnesses that deviate from these values may lead to undesirable results similar to those described above for the core center hardness (Cc).

The cross-sectional hardness Cm at the midpoint M of the core, although not particularly limited, may be set to preferably at least 60, more preferably at least 62, and even more preferably at least 64. Although there is no particular upper limit, the hardness Cm may be set to preferably not more than 72, more preferably not more than 70, and even more preferably not more than 68. Hardnesses that deviate from these values may lead to undesirable results similar to those described above for the core center hardness (Cc).

The hardness Cm+2 at a position 2 mm outward toward the core surface from the midpoint M of the core, although not particularly limited, may be set to preferably at least 63, more preferably at least 65, and even more preferably at least 67. Although there is no particular upper limit, the hardness Cm+2 may be set to preferably not more than 77, more preferably not more than 75, and even more preferably not more than 73. When this value is too large, the durability to cracking on repeated impact may worsen, or the feel at impact may become too hard. On the other hand, when this value is too small, the rebound may become low or the spin rate on full shots may rise, as a result of which the intended distance may not be attainable.

The hardness Cm+4 at a position 4 mm outward from the midpoint M of the core, although not particularly limited, may be set to preferably at least 69, more preferably at least 71, and even more preferably at least 73. Although there is no particular upper limit, the hardness Cm+4 may be set to preferably not more than 82, more preferably not more than 80, and even more preferably not more than 78. Hardnesses that deviate from these values may lead to undesirable results similar to those described above for the hardness at a position 2 mm from the midpoint M of the core (Cm+2).

The hardness Cm+6 at a position 6 mm outward from the midpoint M of the core, although not particularly limited, may be set to preferably at least 73, more preferably at least 75, and even more preferably at least 77. Although there is no particular upper limit, the hardness Cm+6 may be set to preferably not more than 85, more preferably not more than 83, and even more preferably not more than 81. Hardnesses that deviate from these values may lead to undesirable results similar to those described above for the hardness at a position 2 mm from the midpoint M of the core (Cm+2).

The core surface hardness Cs, although not particularly limited, may be set to preferably at least 80, more preferably at least 82, and even more preferably at least 84. Although there is no particular upper limit, the core surface hardness Cs may be set to preferably not more than 91, more preferably not more than 89, and even more preferably not more than 87. When this value is too large, the feel at impact may become hard, or the spin rate on full shots may rise, as a result of which the intended distance may not be attainable. The surface hardness (Cs) refers to the hardness measured at the spherical surface of the core.

The hardness difference between the core center and core surface is optimized so as to make the hardness difference between the core interior and the core exterior large. That is, the Shore C hardness value obtained by subtracting the core center hardness (Cc) from the core surface hardness (Cs), expressed as Cs−Cc, may be set to preferably at least 20, more preferably at least 22, and even more preferably at least 23. Although there is no particular upper limit, this value may be set to preferably not more than 30, more preferably not more than 28, and even more preferably not more than 25. When this hardness difference is too small, the spin rate-lowering effect on shots with a driver (W #1) may be inadequate and a good distance may not be achieved by golfers whose head speed is not fast. On the other hand, when this hardness difference is too large, the initial velocity on shots may be low and a good distance may not be achieved by golfers whose head speed is not fast, or the durability to cracking on repeated impact may worsen.

In the above-described core hardness profile in this invention, the surface areas A to F and X defined as follows:

surface area X: ½×2×(Cm−6-Cm−8)
surface area A: ½×2×(Cm−4-Cm−6)
surface area B: ½×2×(Cm−2-Cm−4)
surface area C: ½×2×(Cm-Cm−2)
surface area D: ½×2×(Cm+2-Cm),
surface area E: ½×2×(Cm+4-Cm+2)
surface area F: ½ 2×(Cm+6-Cm+4)

are characterized in that the value of (surface area D+surface area E+surface area F)−(surface area A+surface area B+surface area C) is preferably more than 0, more preferably 2.0 or more, and even more preferably 4.0 or more, and the upper limit is preferably not more than 20.0, more preferably not more than 16.0, and even more preferably not more than 12.0. When this value is too small, the spin rate-lowering effect on shots with a driver (W #1) may be inadequate, as a result of which golfers whose head speed is not fast may not achieve a good distance. On the other hand, when this value is large, the initial velocity on shots may become low and so golfers whose head speed is not fast may not achieve a good distance, or the durability to cracking on repeated impact may worsen.

Surface areas A to F and X are such that the value of (surface area D+surface area E+surface area F)−(surface area X+surface area A+surface area B+surface area C), although not particularly limited, is preferably more than 0, more preferably 2.0 or more, and even more preferably 4.0 or more. The upper limit is preferably not more than 20.0, more preferably not more than 16.0, and even more preferably not more than 12.0. A value outside of this range may lead to undesirable results similar to those described above for the value of (surface area D+surface area E+surface area F)−(surface area A+surface area B+surface area C).

Surface areas A to E are such that the value of (surface area D+surface area E)−(surface area A+surface area B+surface area C), although not particularly limited, is preferably 1.0 or more, more preferably 2.0 or more, and even more preferably 3.0 or more. The upper limit is preferably not more than 14.0, more preferably not more than 11.0, and even more preferably not more than 8.0. A value outside of this range may lead to undesirable results similar to those described above for the value of (surface area D+surface area E+surface area F)−(surface area A+surface area B+surface area C).

Surface areas A to E and X are such that the value of (surface area D+surface area E)−(surface area X+surface area A+surface area B+surface area C), although not particularly limited, is preferably more than 0, more preferably 1.0 or more, and even more preferably 2.0 or more. The upper limit is preferably not more than 14.0, more preferably not more than 11.0, and even more preferably not more than 8.0. A value outside of this range may lead to undesirable results similar to those described above for the value of (surface area D+surface area E+surface area F)−(surface area A+surface area B+surface area C).

Surface areas A to F, the core center hardness Cc and the core surface hardness Cs preferably satisfy the condition $$0<[(\text{surface areas } D+E+F)-(\text{surface areas } A+B+C)]/(Cs-Cc)\leq 1.00,$$

more preferably satisfy the condition $$0.10\leq[(\text{surface areas } D+E+F)-(\text{surface areas } A+B+C)]/(Cs-Cc)\leq 0.80,$$

and even more preferably satisfy the condition $$0.20<[(\text{surface areas } D+E+F)-(\text{surface areas } A+B+C)]/(Cs-Cc)\leq 0.60.$$

Figure 2:
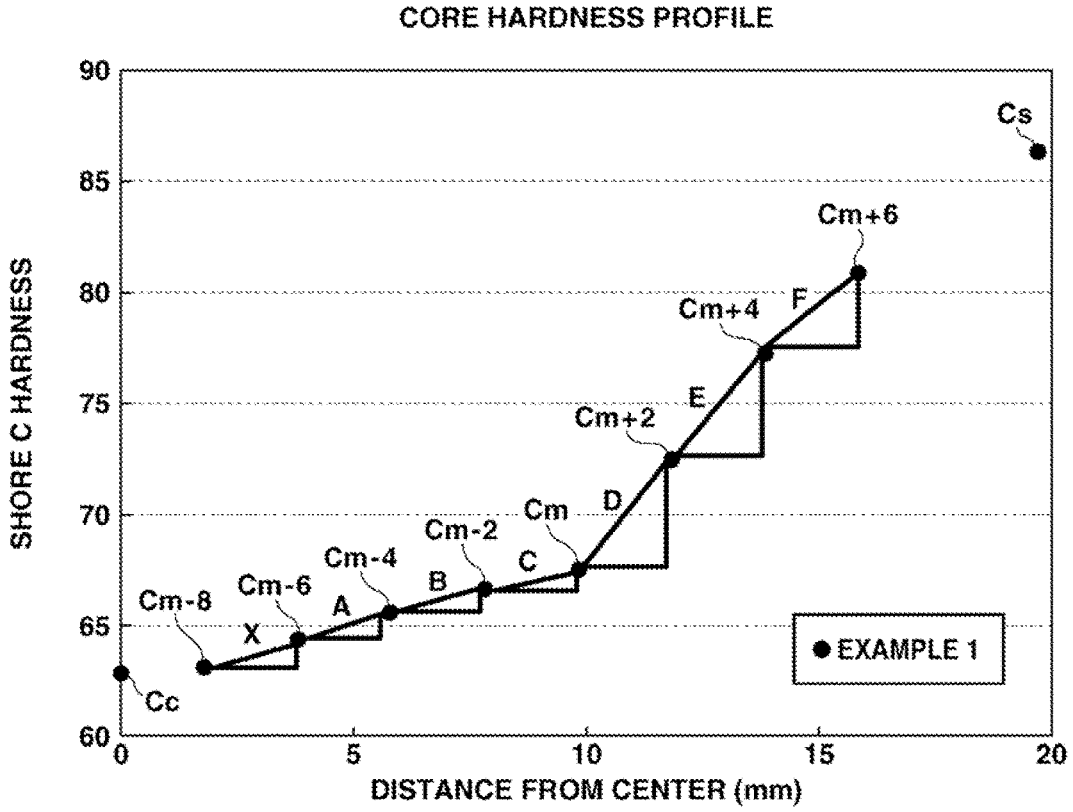
FIG. 2 is a graph that uses core hardness profile data from Example 1 to explain surface areas A to F and X in the core hardness profile.

FIG. 2 shows a graph that uses core hardness profile data from Example 1 to explain surface areas A to F and X. As is apparent from the graph, each of surface areas A to F and X is the surface area of a triangle whose base is the difference between specific distances and whose height is the difference in hardness between the positions at these specific distances.

Next, the intermediate layer is described.

The intermediate layer has a material hardness on the Shore D hardness scale which, although not particularly limited, is preferably at least 60, more preferably at least 62, and even more preferably at least 64. The upper limit is preferably not more than 72, more preferably not more than 70, and even more preferably not more than 68. The surface hardness of the sphere obtained by encasing the core with the intermediate layer (intermediate layer-encased sphere), expressed on the Shore D hardness scale, is preferably at least 66, more preferably at least 68, and even more preferably at least 70. The upper limit is preferably not more than 78, more preferably not more than 76, and even more preferably not more than 74. When the material and surface hardnesses of the intermediate layer are lower than the above ranges, even on shots taken by a golfer whose head speed is not fast, the spin rate on full shots may rise excessively and so a good distance may not be achieved, or the initial velocity of the ball may be low, as a result of which a good distance may not be achieved on full shots. On the other hand, when the material and surface hardnesses of the intermediate layer are higher than the above ranges, the durability to cracking on repeated impact may worsen or the feel on impact may worsen.

The intermediate layer has a material hardness on the Shore C hardness scale which is preferably at least 88, more preferably at least 89, and even more preferably at least 92. The upper limit value is preferably not more than 98, more preferably not more than 96, and even more preferably not more than 94. The intermediate layer-encased sphere has a surface hardness on the Shore C hardness scale which is preferably at least 92, more preferably at least 94, and even more preferably at least 96. The upper limit value is preferably not more than 100, more preferably not more than 99, and even more preferably not more than 98.

The intermediate layer has a thickness which is preferably at least 0.9 mm, more preferably at least 1.1 mm, and even more preferably at least 1.2 mm. The upper limit in the intermediate layer thickness is preferably not more than 1.8 mm, more preferably not more than 1.6 mm, and even more preferably not more than 1.4 mm. When the intermediate layer is too thin, the durability to cracking on repeated impact may worsen, or the spin rate on full shots with an iron may rise and a good distance may not be achieved. On the other hand, when the intermediate layer is too thick, the initial velocity may be low and a golfer whose head speed is not fast may not achieve a good distance, or the feel at impact may worsen.

It is preferable to use an ionomer resin as the chief material making up the intermediate layer. The ionomer resin material used is preferably one obtained by blending a high-acid ionomer resin having an unsaturated carboxylic acid content (also referred to below as the "acid content") of at least 16 wt %. With this blend, a lower spin rate and a higher rebound are achieved on full shots, enabling golfers whose head speed is not fast to attain the intended distance.

The amount of unsaturated carboxylic acid included in the high-acid ionomer resin (acid content) is generally at least 16 wt %, preferably at least 17 wt %, and more preferably at least 18 wt %. The upper limit is preferably not more than 22 wt %, more preferably not more than 21 wt %, and even more preferably not more than 20 wt %. When this value is too small, the spin rate on full shots may rise, as a result of which the intended distance may not be attainable. On the other hand, when this value is too large, the feel at impact may become too hard or the durability to cracking on repeated impact may worsen.

The amount of high-acid ionomer resin included per 100 wt % of the resin material is preferably at least 10 wt %, more preferably at least 30 wt %, and even more preferably at least 60 wt %. When the content of this high-acid ionomer resin is too low, the spin rate on shots with a driver (W #1) may rise and a good distance may not be achieved.

Depending on the intended use, optional additives may be suitably included in the intermediate layer material. For example, pigments, dispersants, antioxidants, ultraviolet absorbers and light stabilizers may be added. When these additives are included, the amount added per 100 parts by weight of the base resin is preferably at least 0.1 part by weight, and more preferably at least 0.5 part by weight. The upper limit is preferably not more than 10 parts by weight, and more preferably not more than 4 parts by weight.

It is desirable to abrade the surface of the intermediate layer in order to increase adhesion of the intermediate layer material with the polyurethane that is preferably used in the subsequently described cover material. In addition, it is desirable to apply a primer (adhesive) to the surface of the intermediate layer following such abrasion treatment or to add an adhesion reinforcing agent to the intermediate layer material.

The intermediate layer material has a specific gravity which is preferably at least 0.90, more preferably at least 0.93, and even more preferably at least 0.95. The upper limit value is preferably 1.08 or less, more preferably 1.05 or less, and even more preferably 1.00 or less. When the specific gravity is too large, this may hinder the spin rate-lowering effect on full shots, and so a golfer whose head speed is not fast may be unable to achieve the intended distance. On the other hand, in cases where the specific gravity is too small, owing to the use of a technique such as, for example, expanding the resin and providing cells at the interior, the durability on repeated impact may worsen or the rebound may decrease, as a result of which a good distance may not be achieved by golfers whose head speed is not fast.

Next, the cover, which serves as the outermost layer, is described.

The cover has a material hardness on the Shore D hardness scale which, although not particularly limited, is preferably at least 35, more preferably at least 40, and even more preferably at least 45. The upper limit is preferably not more than 60, more preferably not more than 55, and even more preferably not more than 50. The surface hardness of the sphere obtained by encasing the intermediate layer-encased sphere with the cover (i.e., the ball surface hardness), expressed on the Shore D hardness scale, is preferably at least 50, more preferably at least 53, and even more preferably at least 56. The upper limit is preferably not more than 70, more preferably not more than 67, and even more preferably not more than 64. When the material hardness of the cover and the ball surface hardness are lower than the respective above ranges, the spin rate of the ball on full shots with an iron may rise and a good distance may not be achieved under any hitting conditions. On the other hand, when the material hardness of the cover and the ball surface hardness are higher than the above ranges, the ball may not be receptive to spin on approach shots or the scuff resistance may worsen.

The cover has a material hardness on the Shore C hardness scale which is preferably at least 57, more preferably at least 63, and even more preferably at least 70. The upper limit value is preferably not more than 89, more preferably not more than 83, and even more preferably not more than 76. The surface hardness of the ball, expressed on the Shore C hardness scale, is preferably at least 75, more preferably at least 80, and even more preferably at least 85. The upper limit value is preferably not more than 95, more preferably not more than 92, and even more preferably not more than 90.

The cover has a thickness of preferably at least 0.3 mm, more preferably at least 0.45 mm, and even more preferably at least 0.6 mm. The upper limit in the cover thickness is preferably not more than 1.2 mm, more preferably not more than 1.15 mm, and even more preferably not more than 1.0 mm. When the cover is too thick, the rebound on full shots with an iron may be inadequate or the spin rate may rise, as a result of which a good distance may not be achieved. On the other hand, when the cover is too thin, the scuff resistance may worsen or the ball may not be fully receptive to spin on approach shots and may thus lack sufficient controllability.

The combined thickness of the intermediate layer and the cover, although not particularly limited, is preferably at least 1.4 mm, more preferably at least 1.7 mm, and even more preferably at least 2.0 mm. The upper limit is preferably not more than 2.8 mm, more preferably not more than 2.5 mm, and even more preferably not more than 2.3 mm. When the combined thickness is lower than this range, the durability of the ball to cracking on repeated impact may worsen, or the feel at impact may worsen. On the other hand, when the combined thickness is higher than this range, the spin rate on full shots may rise and so not only golfers having a high head speed but also golfers whose head speed is not fast may be unable to achieve a good distance.

Various types of thermoplastic resins used in golf ball cover stock may be added as the cover material. For reasons having to do with controllability and scuff resistance, a urethane resin is used as the chief material. That is, in the golf ball of the invention, a cover made of urethane resin is needed in order to be able to shorten the run on iron shots and have the ball stop on the green, and also to increase ball controllability in the short game. In particular, from the standpoint of the mass productivity of the manufactured balls, it is preferable to use a material that is composed primarily of a thermoplastic polyurethane, and more preferable to form the cover of a resin blend in which the chief components are (I) a thermoplastic polyurethane and (II) a polyisocyanate compound.

The total weight of components (I) and (II) combined is preferably at least 60%, and more preferably at least 70%, of the overall amount of the cover-forming resin composition. Components (I) and (II) are described in detail below.

The thermoplastic polyurethane (1) has a structure which includes soft segments composed of a polymeric polyol (polymeric glycol) that is a long-chain polyol, and hard segments composed of a chain extender and a polyisocyanate compound. Here, the long-chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of the ability to synthesize a thermoplastic polyurethane having a high rebound resilience and excellent low-temperature properties, a polyether polyol is preferred.

Any chain extender that has hitherto been employed in the art relating to thermoplastic polyurethanes may be suitably used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, the chain extender is preferably an aliphatic diol having from 2 to 12 carbon atoms, and is more preferably 1,4-butylene glycol.

Any polyisocyanate compound hitherto employed in the art relating to thermoplastic polyurethanes may be suitably used without particular limitation as the polyisocyanate compound. For example, use may be made of one or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reactions during injection molding may be difficult to control. In the practice of the invention, to provide a balance between stability at the time of production and the properties that are manifested, it is most preferable to use the following aromatic diisocyanate: 4,4'-diphenylmethane diisocyanate.

Commercially available products may be used as the thermoplastic polyurethane serving as component (I). Illustrative examples include Pandex T-8295, Pandex T-8290 and Pandex T-8260 (all from DIC Covestro Polymer, Ltd.).

A thermoplastic elastomer other than the above thermoplastic polyurethanes may also be optionally included as a separate component, i.e., component (III), together with above components (I) and (II). By including this component (III) in the above resin blend, the flowability of the resin blend can be further improved and the properties required of a golf ball cover material, such as resilience and scuff resistance, can be increased.

The compositional ratio of above components (I), (II) and (III) is not particularly limited. However, to fully elicit the advantageous effects of the invention, the compositional ratio (I):(II):(III) is preferably in the weight ratio range of from 100:2:50 to 100:50:0, and is more preferably from 100:2:50 to 100:30:8.

In addition, various additives other than the ingredients making up the above thermoplastic polyurethane may be optionally included in this resin blend. For example, pigments, dispersants, antioxidants, light stabilizers, ultraviolet absorbers and internal mold lubricants may be suitably included.

The manufacture of golf balls in which the above-described core, intermediate layer and cover (outermost layer) are formed as successive layers may be carried out in the usual manner, such as by a known injection molding process. For example, a multi-piece golf ball can be produced by injection-molding the intermediate layer material over the core in an injection mold so as to obtain an intermediate layer-encased sphere, and then injection-molding the material for the cover serving as the outermost layer over the intermediate layer-encased sphere. Alternatively, the encasing layers may each be formed by enclosing the sphere to be encased within two half-cups that have been pre-molded into hemispherical shapes and then molding under applied heat and pressure.

The golf ball has a deflection when compressed under a final load of 1,275 N (130 kgf) from an initial load of 98 N (10 kgf) which, although not particularly limited, is preferably at least 2.0 mm, more preferably at least 2.2 mm, and even more preferably at least 2.4 mm. The upper limit value is preferably not more than 3.2 mm, more preferably not more than 3.0 mm, and even more preferably not more than 2.8 mm. When the golf ball deflection is too small, i.e., when the ball is too hard, the spin rate may rise excessively even when hit by a golfer whose head speed is not fast, resulting in a poor distance on full shots, or the feel at impact may be too hard. On the other hand, when the deflection is too large, i.e., when the ball is too soft, the durability to cracking on repeated impact may worsen or the initial velocity on shots may be low, as a result of which, even for golfers having a head speed that is not fast, a good distance may not be achieved, especially on shots with a driver (W #1).

Hardness Relationships Among Layers

The intermediate layer-encased sphere has a higher surface hardness than the core, the difference between these surface hardnesses on the Shore C hardness scale being preferably at least 1, more preferably at least 5, and even more preferably at least 10. The upper limit value is preferably not more than 30, more preferably not more than 20, and even more preferably not more than 15. When this value is too small, the spin rate on full shots may rise, as a result of which, even for golfers having a head speed that is not fast, a good distance may not be achieved. When this value is too large, the durability to cracking on repeated impact may worsen.

The intermediate layer-encased sphere has a higher surface hardness than the ball, the difference between these surface hardnesses on the Shore C hardness scale being preferably at least 1, more preferably at least 5, and even more preferably at least 9. The upper limit value is preferably not more than 20, more preferably not more than 17, and even more preferably not more than 15. When this value is small, in cases where this small value is attributable to the material hardness of the intermediate layer, even for golfers having a head speed that is not fast, the spin rate on full shots may rise, as a result of which the intended distance may not be achieved. In cases where this small value is attributable to the material hardness of the cover, the spin controllability in the short game may worsen or the scuff resistance may worsen. On the other hand, when this value is large, in cases where this large value is attributable to the material hardness of the intermediate layer, the durability to cracking on repeated impact may worsen or the feel at impact may become too hard. In cases where this large value is attributable to the material hardness of the cover, even for golfers having a head speed that is not fast, the spin rate on full shots may rise, as a result of which the intended distance may not be achieved.

Deflection Relationship Between Core and Ball

Letting E (mm) be the deflection of the core when compressed under a final load of 1,275 N (130 kgf) from an initial load of 98 N (10 kgf) and B (mm) be the deflection of the ball when compressed under a final load of 1,275 N (130 kgf) from an initial load of 98 N (10 kgf), the value E−B (mm) is preferably at least 0.3 mm, more preferably at least 0.5 mm, and even more preferably at least 0.6 mm; the upper limit is preferably 1.2 mm or less, more preferably 1.0 mm or less, and even more preferably 0.8 mm or less. When this value is too small, the spin rate on full shots may rise and, even for a golfer whose head speed is not fast, a good distance may not be achieved. On the other hand, when this value is too large, the durability to cracking on repeated impact may worsen, or the run of the ball on iron shots may be too long.

The difference in deflection between the ball and the core, expressed as the value B/E, is preferably at least 0.70, more preferably at least 0.73, and even more preferably at least 0.78. The upper limit is preferably not more than 0.84, more preferably not more than 0.82, and even more preferably not more than 0.80. When this value is too small, the durability to cracking on repeated impact may worsen, or the run of the ball on iron shots may be too long. On the other hand, when this value is too large, the spin rate on full shots may rise and, even for a golfer whose head speed is not fast, the intended distance may not be obtained.

In the invention, in an impact test carried out by hitting the ball with a driver at a head speed of 40 m/s, the ratio of deformation time t2 to deformation time t1 (t2/t1) is preferably 1.28 or less. The time t1 is the time required from initial contact by the driver with the ball for deformation of the ball to reach a maximum. The time t2 is the time required from the state of maximum ball deformation for the ball and the clubface of the driver to separate.

The golf ball of the invention is characterized in part based on the results of an impact test. The impact test is carried out by fitting a golf swing robot with a metal head driver (W #1) produced by Bridgestone Sports Co., Ltd. under the product name Tour B XD-5 (loft angle, 9.5°) and striking the golf ball at a head speed (HS) of 40 m/s. The golf ball during impact is photographed using a high-speed video camera (FASTCAM SA-Z, from Photron, Ltd.), the captured images are analyzed and the time t1 required from initial contact of the driver with the ball for deformation of the ball to reach a maximum value and the time t2 required from the state of maximum ball deformation for the ball and driver to separate are determined. Using images of the impact taken from a directly lateral position, the instant at which the diameter of the golf ball in the direction of flight from the plane of contact between the clubface and the ball reaches a minimum is treated as the moment of maximum ball deformation.

The deformation time t1 is preferably at least 260 μsec, more preferably at least 270 μsec, and even more preferably at least 275 μsec. The upper limit is preferably 300 μsec or less, more preferably 295 μsec or less, and even more preferably 285 μsec or less. When this value is too small, especially on full shots with an iron, the spin rate may become too high and a good distance may not be achieved, or the feel at impact may worsen. On the other hand, when this value is too large, the initial velocity may be low so that, especially on impact conditions with a driver (W #1), a good distance is not achieved, or the run on iron shots may be too long.

The deformation time t2 is preferably at least 295 μsec, more preferably at least 305 μsec, and even more preferably at least 315 μsec. The upper limit is preferably 365 μsec or less, more preferably 355 μsec or less, and even more preferably 345 μsec or less. When this value is too small, especially on full shots with an iron, the spin rate may become too high and a good distance may not be achieved, or the feel at impact may worsen. On the other hand, when this value is too large, the initial velocity may be low so that, especially on impact conditions with a driver (W #1), a good distance is not achieved, or the run on iron shots may be too long.

The ratio of deformation time t2 to deformation time t1 (t2/t1) is preferably at least 1.00, more preferably at least 1.05, and even more preferably at least 1.10. The upper limit is preferably 1.28 or less, more preferably 1.25 or less, and even more preferably 1.22 or less. When this value is too small, particularly on full shots with an iron, the spin rate may be too high and a good distance may not be achieved, or the feel at impact may worsen. On the other hand, when this value is too large, the initial velocity may be low and a good distance may not be achieved even under impact conditions with a driver (W #1) in particular, or the run on iron shots may be too long.

The sum of deformation times t1 and t2 is preferably at least 550 μsec, more preferably at least 580 μsec, and even more preferably at least 600 μsec. The upper limit must be 660 μsec or less, and is preferably 645 μsec or less, and more preferably 630 μsec or less. When this value is too small, particularly on full shots with an iron, the spin rate may become too high and a good distance may not be achieved, or the feel at impact may worsen. On the other hand, when this value is too large, the initial velocity is low and a good distance is not achieved, even under impact conditions with a driver (W #1) in particular, or the run on iron shots is too long.

In this invention, the ball diameter must be at least 42.8 mm, and is preferably at least 42.9 mm, and more preferably at least 43.0 mm. The upper limit value for the ball diameter is typically 44.0 mm or less, preferably 43.7 mm or less, and more preferably 43.5 mm or less. When the ball diameter is too small, the distance difference on shots with a driver (W #1) between golfers who have a fast head speed and golfers who do not becomes too large. On the other hand, when the ball diameter is too large, the distance achieved on driver (W #1) shots by golfers whose head speed is not fast decreases and the relative difficulty of playing a game of golf rises, which tends to be disadvantageous for competition.

Numerous dimples may be formed on the outside surface of the cover. The number of dimples arranged on the cover surface, although not particularly limited, is preferably at least 250, more preferably at least 300, and even more preferably at least 320. The upper limit is preferably not more than 380, more preferably not more than 350, and even more preferably not more than 340. When the number of dimples is higher than this range, the ball trajectory may become lower and the distance traveled by the ball may decrease. On the other hand, when the number of dimples is lower that this range, the ball trajectory may become higher and a good distance may not be achieved.

The dimple shapes used may be of one type or may be a combination of two or more types suitably selected from among, for example, circular shapes, various polygonal shapes, dewdrop shapes and oval shapes. When circular dimples are used, the dimple diameter may be set to at least about 2.5 mm and up to about 6.5 mm, and the dimple depth may be set to at least 0.08 mm and up to 0.30 mm.

Also, to optimize the ball trajectory, it is desirable for the value $V_0$ (cylinder volume ratio) defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80.

In order for the aerodynamic properties to be fully manifested, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to preferably at least 70%, more preferably at least 75%, and even more preferably at least 80%. The upper limit is preferably not more than 90%, more preferably not more than 86%, and even more preferably not more than 83%. Outside of the above ranges, the resulting trajectory may not enable a good distance to be attained, and so the ball may fail to travel an acceptable distance.

In order for the inventive golf ball having a ball diameter of at least 42.8 mm to fully achieve an increased distance through optimization of the ball trajectory, it is essential for the dimples on the ball surface to have a volume occupancy ratio VR within the range of 0.80 to 0.92%. As used herein, the VR value refers to the ratio (%) of the sum of the volumes of the individual dimples on the ball surface, each formed below the flat plane circumscribed by the edge of that dimple, with respect to the volume of the ball sphere were the ball to have no dimples thereon. The VR value is preferably at least 0.82%, and more preferably at least 0.85%. The upper limit is preferably not more than 0.91%, and more preferably not more than 0.90%. Outside of this range in values, the ball trajectory is not conducive to obtaining a good distance, and so a fully satisfactory distance cannot be achieved.

A coating layer may be formed on the surface of the cover. This coating layer can be formed by applying various types of coating materials. Because the coating layer must be capable of enduring the harsh conditions of golf ball use, it is desirable to use a coating composition in which the chief component is a urethane coating material composed of a polyol and a polyisocyanate.

The polyol component is exemplified by acrylic polyols and polyester polyols. These polyols include modified polyols. To further increase workability, other polyols may also be added.

It is suitable to use two types of polyester polyol together as the polyol component. In this case, letting the two types of polyester polyol be component (a) and component (b), a polyester polyol in which a cyclic structure has been introduced onto the resin skeleton may be used as the polyester polyol of component (a). Examples include polyester polyols obtained by the polycondensation of a polyol having an alicyclic structure, such as cyclohexane dimethanol, with a polybasic acid; and polyester polyols obtained by the polycondensation of a polyol having an alicyclic structure with a diol or triol and a polybasic acid. A polyester polyol having a multi-branched structure may be used as the polyester polyol of component (b). Examples include polyester polyols having a branched structure, such as NIPPOLAN 800, from Tosoh Corporation.

The polyisocyanate is exemplified without particular limitation by commonly used aromatic, aliphatic, alicyclic and other polyisocyanates. Specific examples include tolylene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate and 1-isocyanato-3,3,5-trimethyl-4-isocyanatomethylcyclohexane. These may be used singly or in admixture.

Depending on the coating conditions, various types of organic solvents may be mixed into the coating composition. Examples of such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether, alicyclic hydrocarbon solvents such as cyclohexane, methyl cyclohexane and ethyl cyclohexane; and petroleum hydrocarbon solvents such as mineral spirits.

The thickness of the coating layer made of the coating composition, although not particularly limited, is typically from 5 to 40 μm, and preferably from 10 to 20 μm. As used herein, "coating layer thickness" refers to the coating thickness obtained by averaging the measurements taken at a total of three places: the center of a dimple and two places located at positions between the dimple center and the dimple edge.

In this invention, the coating layer composed of the above coating composition has an elastic work recovery that is preferably at least 60%, and more preferably at least 80%. At a coating layer elastic work recovery in this range, the coating layer has a high elasticity and so the self-repairing ability is high, resulting in an outstanding abrasion resistance. Moreover, the performance attributes of golf balls coated with this coating composition can be improved. The method of measuring the elastic work recovery is described below.

The elastic work recovery is one parameter of the nanoindentation method for evaluating the physical properties of coating layers, this being a nanohardness test method that controls the indentation load on a micro-newton (μN) order and tracks the indenter depth during indentation to a nanometer (nm) precision. In prior methods, only the size of the deformation (plastic deformation) mark corresponding to the maximum load could be measured. However, in the nanoindentation method, the relationship between the indentation load and the indentation depth can be obtained by continuous automated measurement. Hence, unlike in the past, there are no individual differences between observers when visually measuring a deformation mark under an optical microscope, and so it is thought that the physical properties of the coating layer can be precisely evaluated. Given that the coating layer on the ball surface is strongly affected by the impact of the driver and various other types of clubs and has a not inconsiderable influence on the golf ball properties, measuring the coating layer by the nanohardness test method and carrying out such measurement to a higher precision than in the past is a very effective method of evaluation.

The hardness of the coating layer, as expressed on the Shore M hardness scale, is preferably at least 40, and more preferably at least 60. The upper limit is preferably not more than 95, and more preferably not more than 85. This Shore M hardness is obtained in accordance with ASTM D2240. The hardness of the coating layer, as expressed on the Shore C hardness scale, is preferably at least 40 and has an upper limit of preferably not more than 80. This Shore C hardness is obtained in accordance with ASTM D2240. At coating layer hardnesses that are higher than these ranges, the coating may become brittle when the ball is repeatedly struck, which may make it incapable of protecting the cover layer. On the other hand, coating layer hardnesses that are lower than the above range are undesirable because the ball surface is more easily damaged when striking a hard object.

When the above coating composition is used, the formation of a coating layer on the surface of golf balls manufactured by a known method can be carried out via the steps of preparing the coating composition at the time of application, applying the composition onto the golf ball surface by a conventional coating operation, and drying the applied composition. The coating method is not particularly limited. For example, spray painting, electrostatic painting or dipping may be suitably used.

EXAMPLES

The following Examples and Comparative Examples are provided to illustrate the invention, and are not intended to limit the scope thereof.

Examples 1 to 4, Comparative Examples 1 to 7

Formation of Core

Solid cores are produced by preparing rubber compositions for the respective Examples and Comparative Examples shown in Table 1, and then vulcanizing the compositions under the temperature and time conditions shown in the table.

TABLE 1

| Core formulation | Example | | | | Comparative Example | | | | | | |
|---|---|---|---|---|---|---|---|---|---|---|---|
| (pbw) | 1 | 2 | 3 | 4 | 1 | 2 | 3 | 4 | 5 | 6 | 7 |
| Polybutadiene A | 100 | 100 | 100 | 100 | 100 | 100 | 100 | 100 | | | 100 |
| Polybutadiene B | | | | | | | | | 100 | 100 | |
| Zinc acrylate | 36 | 36 | 36 | 36 | 36 | 36 | 36 | 36 | 35 | 35 | 36 |
| Organic peroxide | 1 | 1 | 1 | 1 | 1 | 1 | 1 | 1 | 0.6 | 0.6 | 1 |
| Water | 0.4 | 0.4 | 0.4 | 0.4 | 0.4 | 0.4 | 0.4 | 0.4 | 0.8 | 0.8 | 0.4 |
| Antioxidant | 0.1 | 0.1 | 0.1 | 0.1 | 0.1 | 0.1 | 0.1 | 0.1 | 0.1 | 0.1 | 0.1 |
| Zinc oxide | 11.1 | 11.1 | 11.1 | 3.9 | 16.3 | 11.1 | 11.1 | 16.3 | 12.5 | 18.3 | 14.8 |
| Zinc salt of pentachlorothiophenol | 0.4 | 0.4 | 0.4 | 1.0 | 0.4 | 0.4 | 0.4 | 0.4 | 1.0 | 1.0 | 0.4 |
| Vulcanization temperature (° C.) | 150 | 150 | 150 | 150 | 150 | 150 | 150 | 150 | 153 | 153 | 150 |
| Vulcanization time (min) | 19 | 19 | 19 | 19 | 19 | 19 | 19 | 19 | 19 | 19 | 19 |

Details on the ingredients mentioned in Table 1 are given below.

Polybutadiene A: Available under the trade name "BR 01" from JSR Corporation

Polybutadiene B: Available under the trade name "BR 730" from JSR Corporation

Zinc acrylate: "ZN-DA85S" from Nippon Shokubai Co., Ltd.

Organic Peroxide: Dicumyl peroxide, available under the trade name "Percumyl D" from NOF Corporation Water: Pure water (from Seiki Chemical Industrial Co., Ltd.)

Antioxidant: 2,2'-Methylenebis(4-methyl-6-butylphenol), available under the trade name "Nocrac NS-6" from Ouchi Shinko Chemical Industry Co., Ltd.

Zinc oxide: Available as "Grade 3 Zinc Oxide" from Sakai Chemical Co., Ltd.

Zinc salt of pentachlorothiophenol:

Available from Wako Pure Chemical Industries, Ltd.

Formation of Intermediate Layer and Cover (Outermost Layer)

Next, in each of the Examples and Comparative Examples, an intermediate layer is formed by injection-molding the intermediate layer material formulated as shown in Table 2 over the core obtained above, thereby producing an intermediate layer-encased sphere. A cover (outermost layer) is then formed by injection-molding the cover material formulated as shown in the same table over the resulting intermediate layer-encased sphere, thereby producing the golf ball. A plurality of dimples configured as shown in Table 3 below are formed at this time on the surface of the cover.

TABLE 2

| Resin composition (pbw) | No. 1 | No. 2 | No. 3 | No. 4 |
|---|---|---|---|---|
| Himilan ® 1605 | | 50 | | |
| Himilan ® 1557 | | 15 | | |
| Himilan ® 1706 | 15 | 35 | | |
| AM7318 | 85 | | | |
| Surlyn ™ 7930 | | | 47 | |
| Surlyn ™ 6320 | | | 40 | |
| Nucrel ™ 9-1 | | | 13 | |
| Titanium oxide | | | 5 | |
| Trimethylolpropane | 1.1 | 1.1 | | |
| TPU | | | | 100 |

Trade names for the materials in the above table are given below.

Himilan®: Ionomers available from Dow-Mitsui Polychemicals Co., Ltd.

AM7318: An ionomer available from Dow-Mitsui Polychemicals Co., Ltd.

Surlyn™: Ionomers available from The Dow Chemical Company

Nucrel™ 9-1: An ethylene-methacrylic acid copolymer available from the DuPont Company Trimethylolpropane (TMP): Available from Tokyo Chemical Industry Co., Ltd.

TPU: An ether-type thermoplastic polyurethane available as Pandex® from DIC Covestro Polymer, Ltd.

Figure 6A:
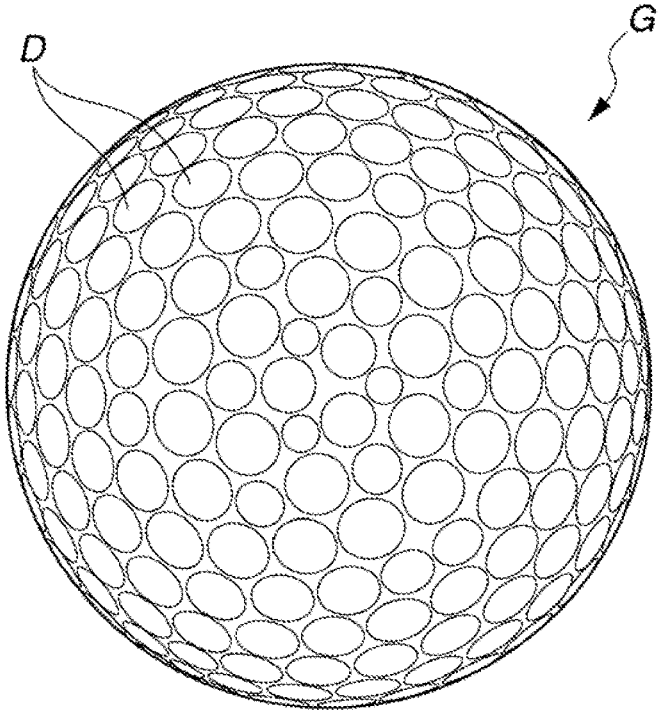
FIG. 6A is a plan view and FIG. 6B is a side view showing the dimple pattern common to the Examples and the Comparative Examples.
Figure 6B:
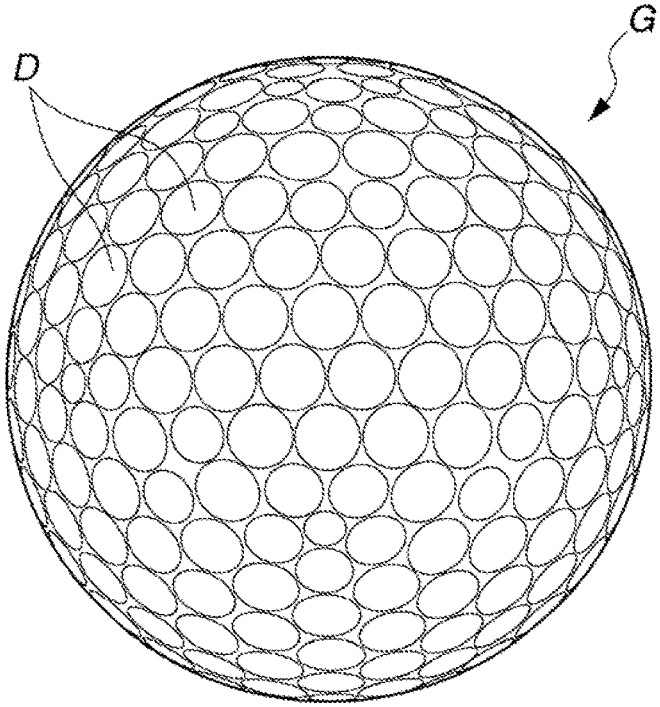

The dimples in the respective Examples and Comparative Examples have the arrangement (pattern) shown in FIG. 6. FIG. 6A is a top view of the dimples, and FIG. 6B is a side view of the dimples. The respective dimple configurations A to H below were used in the Examples. Each of these dimple configuration include eight types of circular dimples (No. 1 to No. 8) of differing diameter and depth. The details are shown in Table 3 (Dimples A to D) and Table 4 (Dimples E to H) below.

TABLE 3

| | Type | Number | Diameter (mm) | Depth (mm) | Volume ($mm^3$) | Cylinder volume ratio | SR (%) | VR (%) |
|---|---|---|---|---|---|---|---|---|
| Dimple A | No. 1 | 12 | 4.60 | 0.118 | 1.111 | 0.566 | 82.3 | 0.77 |
| | No. 2 | 198 | 4.45 | 0.117 | 1.031 | 0.566 | | |
| | No. 3 | 36 | 3.85 | 0.114 | 0.752 | 0.566 | | |
| | No. 4 | 12 | 2.75 | 0.085 | 0.286 | 0.566 | | |
| | No. 5 | 36 | 4.45 | 0.126 | 1.110 | 0.566 | | |
| | No. 6 | 24 | 3.85 | 0.123 | 0.811 | 0.566 | | |
| | No. 7 | 6 | 3.40 | 0.115 | 0.558 | 0.534 | | |
| | No. 8 | 6 | 3.30 | 0.115 | 0.526 | 0.534 | | |
| | Total | 330 | | | | | | |
| Dimple B | No. 1 | 12 | 4.67 | 0.120 | 1.164 | 0.566 | 82.3 | 0.77 |
| | No. 2 | 198 | 4.52 | 0.119 | 1.081 | 0.566 | | |
| | No. 3 | 36 | 3.92 | 0.116 | 0.793 | 0.566 | | |
| | No. 4 | 12 | 2.82 | 0.087 | 0.308 | 0.566 | | |
| | No. 5 | 36 | 4.52 | 0.128 | 1.163 | 0.566 | | |
| | No. 6 | 24 | 3.92 | 0.125 | 0.854 | 0.566 | | |
| | No. 7 | 6 | 3.47 | 0.117 | 0.591 | 0.534 | | |
| | No. 8 | 6 | 3.37 | 0.117 | 0.558 | 0.534 | | |
| | Total | 330 | | | | | | |
| Dimple C | No. 1 | 12 | 4.63 | 0.127 | 1.211 | 0.566 | 82.3 | 0.82 |
| | No. 2 | 198 | 4.48 | 0.126 | 1.125 | 0.566 | | |
| | No. 3 | 36 | 3.88 | 0.123 | 0.824 | 0.566 | | |
| | No. 4 | 12 | 2.78 | 0.094 | 0.323 | 0.566 | | |
| | No. 5 | 36 | 4.48 | 0.135 | 1.205 | 0.566 | | |
| | No. 6 | 24 | 3.88 | 0.132 | 0.884 | 0.566 | | |
| | No. 7 | 6 | 3.43 | 0.124 | 0.612 | 0.534 | | |
| | No. 8 | 6 | 3.33 | 0.124 | 0.577 | 0.534 | | |
| | Total | 330 | | | | | | |
| Dimple D | No. 1 | 12 | 4.63 | 0.135 | 1.287 | 0.566 | 82.3 | 0.87 |
| | No. 2 | 198 | 4.48 | 0.134 | 1.196 | 0.566 | | |
| | No. 3 | 36 | 3.88 | 0.131 | 0.877 | 0.566 | | |
| | No. 4 | 12 | 2.78 | 0.102 | 0.351 | 0.566 | | |
| | No. 5 | 36 | 4.48 | 0.143 | 1.277 | 0.566 | | |
| | No. 6 | 24 | 3.88 | 0.140 | 0.937 | 0.566 | | |
| | No. 7 | 6 | 3.43 | 0.132 | 0.652 | 0.534 | | |
| | No. 8 | 6 | 3.33 | 0.132 | 0.614 | 0.534 | | |
| | Total | 330 | | | | | | |

TABLE 4

| | Type | Number | Diameter (mm) | Depth (mm) | Volume ($mm^3$) | Cylinder volume ratio | SR (%) | VR (%) |
|---|---|---|---|---|---|---|---|---|
| Dimple E | No. 1 | 12 | 4.63 | 0.139 | 1.111 | 0.566 | 82.3 | 0.90 |
| | No. 2 | 198 | 4.48 | 0.138 | 1.031 | 0.566 | | |
| | No. 3 | 36 | 3.88 | 0.135 | 0.752 | 0.566 | | |
| | No. 4 | 12 | 2.78 | 0.106 | 0.286 | 0.566 | | |
| | No. 5 | 36 | 4.48 | 0.147 | 1.110 | 0.566 | | |
| | No. 6 | 24 | 3.88 | 0.144 | 0.811 | 0.566 | | |
| | No. 7 | 6 | 3.43 | 0.136 | 0.558 | 0.534 | | |
| | No. 8 | 6 | 3.33 | 0.136 | 0.526 | 0.534 | | |
| | Total | 330 | | | | | | |
| Dimple F | No. 1 | 12 | 4.63 | 0.144 | 1.373 | 0.566 | 82.3 | 0.93 |
| | No. 2 | 198 | 4.48 | 0.143 | 1.277 | 0.566 | | |
| | No. 3 | 36 | 3.88 | 0.14 | 0.937 | 0.566 | | |
| | No. 4 | 12 | 2.78 | 0.111 | 0.382 | 0.566 | | |
| | No. 5 | 36 | 4.48 | 0.152 | 1.357 | 0.566 | | |
| | No. 6 | 24 | 3.88 | 0.149 | 0.998 | 0.566 | | |
| | No. 7 | 6 | 3.43 | 0.141 | 0.696 | 0.534 | | |
| | No. 8 | 6 | 3.33 | 0.141 | 0.656 | 0.534 | | |
| | Total | 330 | | | | | | |
| Dimple G | No. 1 | 12 | 4.60 | 0.134 | 1.261 | 0.566 | 82.3 | 0.87 |
| | No. 2 | 198 | 4.45 | 0.133 | 1.171 | 0.566 | | |
| | No. 3 | 36 | 3.85 | 0.130 | 0.857 | 0.566 | | |

TABLE 4-continued

| | Type | Number | Diameter (mm) | Depth (mm) | Volume ($mm^3$) | Cylinder volume ratio | SR (%) | VR (%) |
|---|---|---|---|---|---|---|---|---|
| | No. 4 | 12 | 2.75 | 0.101 | 0.340 | 0.566 | | |
| | No. 5 | 36 | 4.45 | 0.142 | 1.251 | 0.566 | | |
| | No. 6 | 24 | 3.85 | 0.139 | 0.916 | 0.566 | | |
| | No. 7 | 6 | 3.40 | 0.131 | 0.635 | 0.534 | | |
| | No. 8 | 6 | 3.30 | 0.131 | 0.599 | 0.534 | | |
| | Total | 330 | | | | | | |
| Dimple H | No. 1 | 12 | 4.67 | 0.136 | 1.323 | 0.566 | 82.3 | 0.87 |
| | No. 2 | 198 | 4.52 | 0.135 | 1.230 | 0.566 | | |
| | No. 3 | 36 | 3.92 | 0.132 | 0.902 | 0.566 | | |
| | No. 4 | 12 | 2.81 | 0.103 | 0.360 | 0.566 | | |
| | No. 5 | 36 | 4.52 | 0.144 | 1.312 | 0.566 | | |
| | No. 6 | 24 | 3.92 | 0.141 | 0.964 | 0.566 | | |
| | No. 7 | 6 | 3.46 | 0.133 | 0.670 | 0.534 | | |
| | No. 8 | 6 | 3.36 | 0.133 | 0.632 | 0.534 | | |
| | Total | 330 | | | | | | |

Dimple Definitions

Edge: Highest place in cross-section passing through center of dimple.

Diameter: Diameter of flat plane circumscribed by edge of dimple.

Depth: Maximum depth of dimple from flat plane circumscribed by edge of dimple.

SR: Sum of individual dimple surface areas, each defined by flat plane circumscribed by edge of dimple, as a percentage of spherical surface area of ball were it to have no dimples thereon.

Dimple volume: Dimple volume below flat plane circumscribed by edge of dimple.

Cylinder volume ratio: Ratio of dimple volume to volume of cylinder having same diameter and depth as dimple.

VR: Sum of volumes of individual dimples formed below flat plane circumscribed by edge of dimple, as a percentage of volume of ball sphere were it to have no dimples thereon.

Formation of Coating Layer

Next, in each Example and Comparative Example, using the coating composition shown in Table 5 below as a coating composition common to all of the Examples and Comparative Examples, the coating is applied with an air spray gun onto the surface of the cover (outermost layer) having numerous dimples formed thereon, producing golf balls with a 15 μm thick coating layer on top.

TABLE 4

| | | | |
|---|---|---|---|
| Coating composition (pbw) | Base resin | Polyester polyol (A) | 23 |
| | | Polyester polyol (B) | 15 |
| | | Organic solvent | 62 |
| | Curing agent | Isocyanate (HMDI isocyanurate) | 42 |
| | | Solvent | 58 |
| | Molar blending ratio (NCO/OH) | | 0.89 |
| Coating properties | Elastic work recovery (%) | | 84 |
| | Shore M hardness | | 84 |
| | Shore C hardness | | 63 |
| | Thickness (μm) | | 15 |

[Synthesis of Polyester Polyol (A)]

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which the reaction was effected by raising the temperature to between 200 and 240° C. under stirring and heating for 5 hours. This yielded Polyester Polyol (A) having an acid value of 4, a hydroxyl value of 170 and a weight-average molecular weight (Mw) of 28,000.

The Polyester Polyol (A) thus synthesized was then dissolved in butyl acetate, thereby preparing a varnish having a nonvolatiles content of 70 wt %.

The base resin for the coating composition in Table 5 was prepared by mixing together 23 parts by weight of the above polyester polyol solution, 15 parts by weight of Polyester Polyol (B) (the saturated aliphatic polyester polyol NIPPOLAN 800 from Tosoh Corporation; weight-average molecular weight (Mw), 1,000; 100/o solids) and the organic solvent. This mixture had a nonvolatiles content of 38.0 wt %.

Elastic Work Recovery

The elastic work recovery of the coating material is measured using a coating sheet having a thickness of 50 μm. The ENT-2100 nanohardness tester from Erionix Inc. is used as the measurement apparatus, and the measurement conditions are as follows.

Indenter: Berkovich indenter (material: diamond; angle α: 65.03°)

Load F: 0.2 mN

Loading time: 10 seconds

Holding time: 1 second

Unloading time: 10 seconds

The elastic work recovery is calculated as follows, based on the indentation work $W_{elast}$ (Nm) due to spring-back deformation of the coating and on the mechanical indentation work $W_{total}$ (Nm).

$$\text{Elastic work recovery}=W_{elast}/W_{total}\times 100(\%)$$

Shore C Hardness and Shore M Hardness

The Shore C hardness and Shore M hardness in Table 4 above are determined by forming the material being tested into 2 mm thick sheets and stacking three such sheets together to give a test specimen. Measurements are taken using a Shore C durometer and a Shore M durometer in accordance with ASTM D2240.

Various properties of the resulting golf balls, including the internal hardnesses of the core at various positions, the diameters of the core and each layer-encased sphere, the thickness and material hardness of each layer and the surface hardness of each layer-encased sphere, are evaluated by the following methods. The results are presented in Tables 6 and 7.

Diameters of Core and Intermediate Layer-Encased Sphere

The spheres to be measured are held isothermally for at least 3 hours in a thermostatic chamber adjusted to 23.9±1° C., following which they are measured in a 23.9±2° C. room. The diameters at five random places on the surface of each sphere are measured and, using the average of these measurements as the measured value for a single sphere, the average diameter for ten such spheres is determined.

Ball Diameter

The balls to be measured are held isothermally for at least 3 hours in a thermostatic chamber adjusted to 23.9±1° C., following which they are measured in a 23.9±2° C. room. The diameter at 15 random dimple-free areas is measured at a temperature of 23.9±1° C. and, using the average of these measurements as the measured value for a single ball, the average diameter for ten balls is determined.

Deflections of Core and Ball

The core or ball is placed on a hard plate and the amount of deflection when compressed under a final load of 1,275 N (130 kgf) from an initial load of 98 N (10 kgf) is measured. The deflection is a value measured after holding the core or ball isothermally at a temperature of 23.9° C. The rate at which pressure is applied by the head which compresses the ball is set to 10 mm/s.

Core Hardness Profile

The indenter of a durometer is set substantially perpendicular to the spherical surface of the core, and the surface hardness on the Shore C hardness scale is measured in accordance with ASTM D2240. The hardnesses at the center and specific positions of the core are measured as Shore C hardness values by perpendicularly pressing the indenter of a durometer against the center portion and the specific positions shown in Table 6 on the flat cross-section obtained by cutting the core into hemispheres. The P2 Automatic Rubber Hardness Tester (Kobunshi Keiki Co., Ltd.) equipped with a Shore C durometer can be used for measuring the hardness. The maximum value is read off as the hardness value. Measurements are all carried out in a 23±2° C. environment. The numbers in Tables 6 and 7 are Shore C hardness values.

Also, in the core hardness profile, letting Cc be the Shore C hardness at the center of the core, Cm be the Shore C hardness at the midpoint M between the core center and core surface, Cm−2, Cm−4, Cm−6 and Cm−8 be the respective Shore C hardnesses at positions 2 mm, 4 mm, 6 mm and 8 mm inward from the midpoint M, Cm+2, Cm+4 and Cm+6 be the respective Shore C hardnesses at positions 2 mm, 4 mm and 6 mm outward from the midpoint M and Cs be the Shore C hardness at the core surface, the surface areas A to F and X defined as follows surface area X: ½×2×(Cm−6-Cm−8)
surface area A: ½×2×(Cm−4-Cm−6)
surface area B: ½×2×(Cm−2-Cm−4)
surface area C: ½×2×(Cm-Cm−2)
surface area D: ½×2×(Cm+2-Cm)
surface area E: ½×2×(Cm+4-Cm+2)
surface area F: ½×2×(Cm+6-Cm+4), are calculated, and the values of the following nine expressions are determined:

$$\text{surface areas } A+B+C \quad (1)$$

$$\text{surface area } X+A+B+C \quad (2)$$

$$\text{surface areas } D+E \quad (3)$$

$$\text{surface areas } D+E+F \quad (4)$$

$$(\text{surface areas } D+E+F)-(\text{surface areas } A+B+C) \quad (5)$$

$$(\text{surface areas } D+E+F)-(\text{surface areas } X+A+B+C) \quad (6)$$

$$(\text{surface areas } D+E)-(\text{surface areas } A+B+C) \quad (7)$$

$$(\text{surface areas } D+E)-(\text{surface areas } X+A+B+C) \quad (8)$$

$$[(\text{surface areas } D+E+F)-(\text{surface areas } A+B+C)]/(Cs-Cc) \quad (9)$$

Surface areas A to F and X in the core hardness profile are explained in FIG. 2, which is a graph plotted using the core hardness profile data from Example 1.

Figure 3:
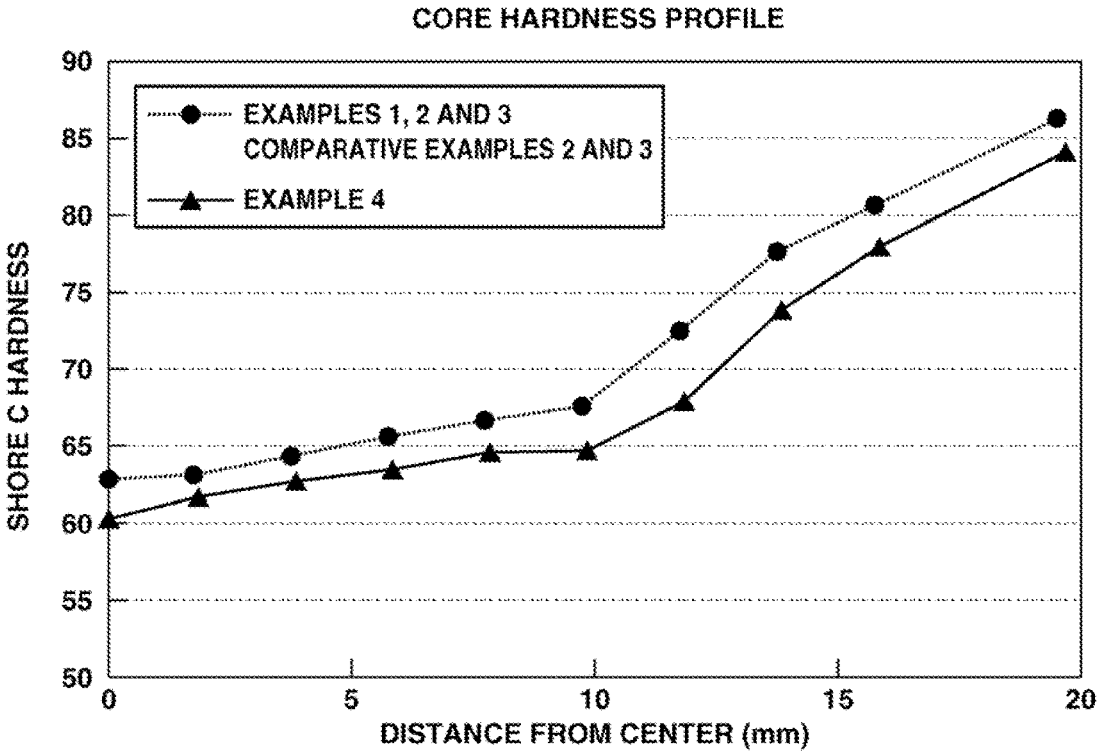
FIG. 3 is a graph showing the core hardness profile in Examples 1 to 4 and Comparative Examples 2 and 3.
Figure 4:
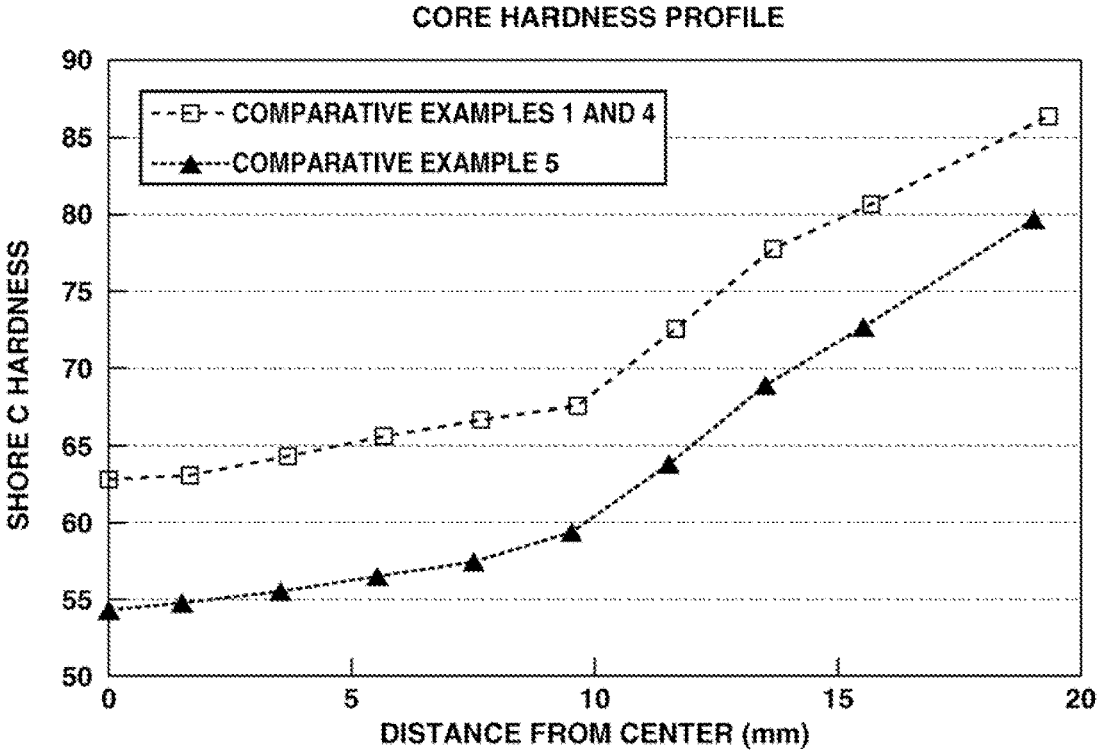
FIG. 4 is a graph showing the core hardness profile in Comparative Examples 1, 4 and 5.
Figure 5:
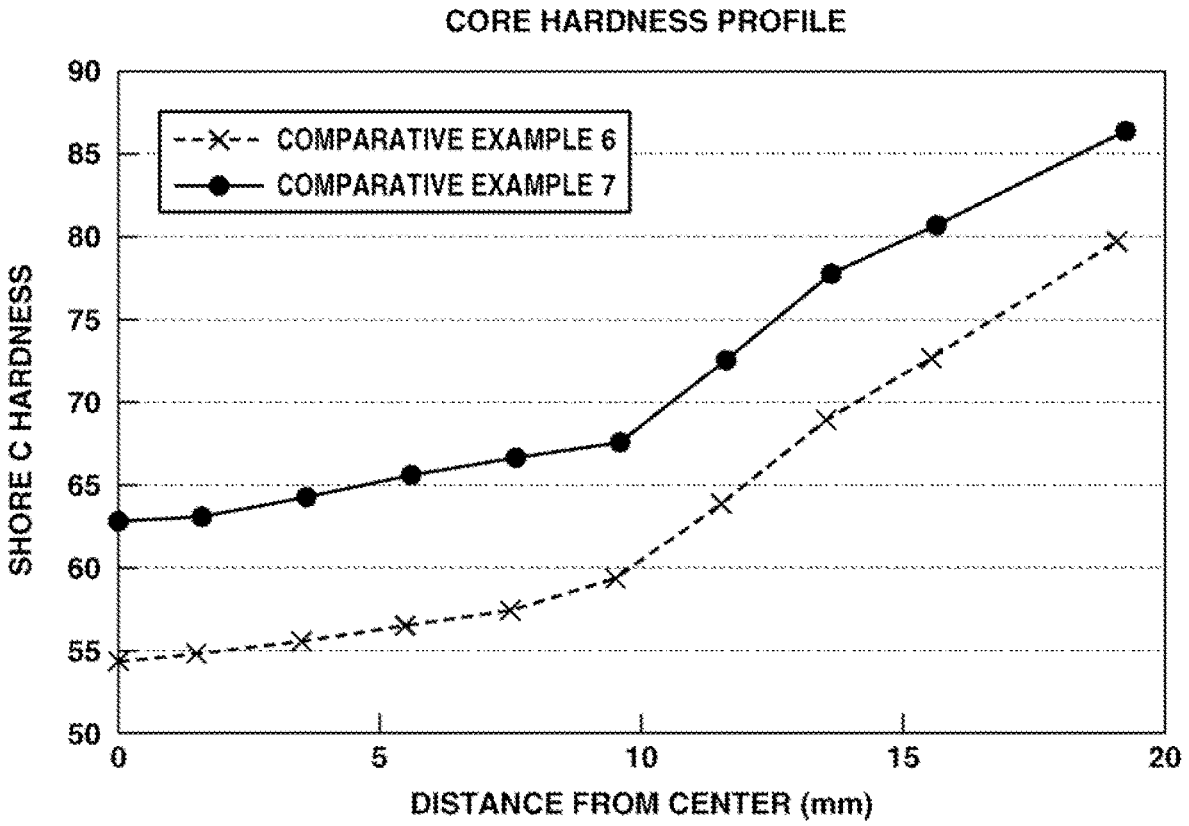
FIG. 5 is a graph showing the core hardness profile in Comparative Examples 6 and 7.

FIGS. 3, 4 and 5 show graphs of the core hardness profiles for Examples 1 to 4 and Comparative Examples 1 to 7.

Material Hardnesses of Intermediate Layer and Cover

The resin material for each layer is molded into a sheet having a thickness of 2 mm and left to stand for at least two weeks. The Shore C hardness and Shore D hardness of each material is then measured in accordance with ASTM D2240. The P2 Automatic Rubber Hardness Tester (Kobunshi Keiki Co., Ltd.) is used for measuring the hardness. Shore C hardness and Shore D hardness attachments are mounted on the tester and the respective hardnesses are measured. The maximum value is read off as the hardness value. All measurements are carried out in a 23±2° C. environment.

Surface Hardnesses of Intermediate Layer-Encased Sphere and Ball

These hardnesses are measured by perpendicularly pressing an indenter against the surfaces of the respective spheres. The surface hardness of a ball (cover) is the value measured at a dimple-free area (land) on the surface of the ball. The Shore C and Shore D hardnesses are measured in accordance with ASTM D2240. The P2 Automatic Rubber Hardness Tester (Kobunshi Keiki Co., Ltd.) is used for measuring the hardness. Shore C hardness and Shore D hardness attachments are mounted on the tester and the respective hardnesses are measured. The maximum value is read off as the hardness value. Measurements are all carried out in a 23±2° C. environment.

Ball Deformation Times

A golf swing robot is fitted with a metal head driver (W #1) produced by Bridgestone Sports Co., Ltd. under the product name Tour B XD-5 (loft angle, 9.5°) and the golf ball is struck at a head speed (HS) of 40 m/s. The golf ball during impact is photographed using a high-speed video camera (FASTCAM SA-Z, from Photron, Ltd.), the captured images are analyzed and the following two times are measured in microseconds: the time t1 required from initial contact of the driver with the ball for deformation of the ball to reach a maximum value and the time t2 required from the state of maximum ball deformation for the ball and driver clubface to separate. Also, using images of the impact taken from a directly lateral position, the instant at which the diameter of the ball in the direction of flight from the plane of contact between the clubface and the ball reaches a minimum is treated as the moment of greatest deformation by the ball.

TABLE 6

| | | Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| Core diameter (mm) | | 38.95 | 38.95 | 38.95 | 39.35 | 38.65 | 38.95 | 38.95 | 38.65 | 38.35 | 38.05 | 38.40 |
| Core weight (g) | | 34.95 | 34.95 | 34.95 | 34.74 | 35.10 | 34.95 | 34.95 | 35.10 | 33.62 | 33.79 | 34.16 |
| Core deflection (mm) | | 3.0 | 3.0 | 3.0 | 3.5 | 3.0 | 3.0 | 3.0 | 3.0 | 4.6 | 4.6 | 3.0 |
| Core hardness profile | Surface hardness: Cs (Shore C) | 86.3 | 86.3 | 86.3 | 84.1 | 86.3 | 86.3 | 86.3 | 86.3 | 79.6 | 79.6 | 86.3 |
| | Position hardness: Cm + 6 (Shore C) | 80.7 | 80.7 | 80.7 | 78.0 | 80.7 | 80.7 | 80.7 | 80.7 | 72.7 | 72.7 | 80.7 |
| | Position hardness: Cm + 4 (Shore C) | 77.7 | 77.7 | 77.7 | 73.9 | 77.7 | 77.7 | 77.7 | 77.7 | 68.9 | 68.9 | 77.7 |
| | Position hardness: Cm + 2 (Shore C) | 72.5 | 72.5 | 72.5 | 68.0 | 72.5 | 72.5 | 72.5 | 72.5 | 63.8 | 63.9 | 72.6 |
| | Position hardness: Cm (Shore C) | 67.6 | 67.6 | 67.6 | 64.7 | 67.6 | 67.6 | 67.6 | 67.6 | 59.4 | 59.4 | 67.6 |
| | Position hardness: Cm − 2 (Shore C) | 66.7 | 66.7 | 66.7 | 64.6 | 66.7 | 66.7 | 66.7 | 66.7 | 57.5 | 57.5 | 66.7 |
| | Position hardness: Cm − 4 (Shore C) | 65.6 | 65.6 | 65.6 | 63.5 | 65.6 | 65.6 | 65.6 | 65.6 | 56.6 | 56.5 | 65.6 |
| | Position hardness: Cm − 6 (Shore C) | 64.4 | 64.4 | 64.4 | 62.7 | 64.3 | 64.4 | 64.4 | 64.3 | 55.6 | 55.6 | 64.3 |
| | Position hardness: Cm − 8 (Shore C) | 63.1 | 63.1 | 63.1 | 61.7 | 63.1 | 63.1 | 63.1 | 63.1 | 54.8 | 54.8 | 63.1 |
| | Center hardness: Cc (Shore C) | 62.9 | 62.9 | 62.9 | 60.3 | 62.9 | 62.9 | 62.9 | 62.9 | 54.4 | 54.4 | 62.9 |
| | Surface hardness − Center hardness (Cs − Cc) | 23.4 | 23.4 | 23.4 | 23.8 | 23.4 | 23.4 | 23.4 | 23.4 | 25.2 | 25.2 | 23.4 |
| | Surface area X: ½ × 2 × (Cm − 6 − Cm − 8) | 1.3 | 1.3 | 1.3 | 1.0 | 1.2 | 1.3 | 1.3 | 1.2 | 0.8 | 0.8 | 1.2 |
| | Surface area A: ½ × 2 × (Cm − 4 − Cm − 6) | 1.2 | 1.2 | 1.2 | 0.8 | 1.3 | 1.2 | 1.2 | 1.3 | 1.0 | 0.9 | 1.3 |
| | Surface area B: ½ × 2 × (Cm − 2 − Cm − 4) | 1.1 | 1.1 | 1.1 | 1.1 | 1.1 | 1.1 | 1.1 | 1.1 | 0.9 | 1.0 | 1.1 |
| | Surface area C: ½ × 2 × (Cm − Cm − 2) | 0.9 | 0.9 | 0.9 | 0.1 | 0.9 | 0.9 | 0.9 | 0.9 | 1.9 | 1.9 | 0.9 |
| | Surface area D: ½ × 2 × (Cm + 2 − Cm) | 4.9 | 4.9 | 4.9 | 3.3 | 4.9 | 4.9 | 4.9 | 4.9 | 4.4 | 4.5 | 5.0 |
| | Surface area E: ½ × 2 × (Cm + 4 − Cm + 2) | 5.2 | 5.2 | 5.2 | 5.9 | 5.2 | 5.2 | 5.2 | 5.2 | 5.1 | 5.0 | 5.1 |
| | Surface area F: ½ × 2 × (Cm + 6 − Cm + 4) | 3.0 | 3.0 | 3.0 | 4.1 | 3.0 | 3.0 | 3.0 | 3.0 | 3.8 | 3.8 | 3.0 |
| | Surface areas A + B + C | 3.2 | 3.2 | 3.2 | 2.0 | 3.3 | 3.2 | 3.2 | 3.3 | 3.8 | 3.8 | 3.3 |
| | Surface areas X + A + B + C | 4.5 | 4.5 | 4.5 | 3.0 | 4.5 | 4.5 | 4.5 | 4.5 | 4.6 | 4.6 | 4.5 |
| | Surface areas D + E | 10.1 | 10.1 | 10.1 | 9.2 | 10.1 | 10.1 | 10.1 | 10.1 | 9.5 | 9.5 | 10.1 |
| | Surface areas D + E + F | 13.1 | 13.1 | 13.1 | 13.3 | 13.1 | 13.1 | 13.1 | 13.1 | 13.3 | 13.3 | 13.1 |
| | (Surface areas D + E + F) − (Surface areas A + B + C) | 9.9 | 9.9 | 9.9 | 11.3 | 9.8 | 9.9 | 9.9 | 9.8 | 9.5 | 9.5 | 9.8 |
| | (Surface areas D + E + F) − (Surface areas X + A + B + C) | 8.6 | 8.6 | 8.6 | 10.3 | 8.6 | 8.6 | 8.6 | 8.6 | 8.7 | 8.7 | 8.6 |
| | (Surface areas D + E) − (Surface areas A + B + C) | 6.9 | 6.9 | 6.9 | 7.2 | 6.8 | 6.9 | 6.9 | 6.8 | 5.7 | 5.7 | 6.8 |
| | (Surface areas D + E) − (Surface areas X + A + B + C) | 5.6 | 5.6 | 5.6 | 6.2 | 5.6 | 5.6 | 5.6 | 5.6 | 4.9 | 4.9 | 5.6 |
| | [(Surface areas D + E + F) − (Surface areas A + B + C)]/(Cs − Cc) | 0.42 | 0.42 | 0.42 | 0.47 | 0.42 | 0.42 | 0.42 | 0.42 | 0.38 | 0.38 | 0.42 |

TABLE 27

| | | Example | | | | Comparative Example | | | | | | |
|---|---|---|---|---|---|---|---|---|---|---|---|---|
| | | 1 | 2 | 3 | 4 | 1 | 2 | 3 | 4 | 5 | 6 | 7 |
| Intermediate layer | Material | No. 1 | No. 1 | No. 1 | No. 1 | No. 1 | No. 1 | No. 1 | No. 1 | No. 2 | No. 2 | No. 1 |
| | Thickness (mm) | 1.20 | 1.20 | 1.20 | 1.20 | 1.20 | 1.20 | 1.20 | 1.20 | 1.50 | 1.50 | 1.20 |
| | Material hardness (Shore C) | 93 | 93 | 93 | 93 | 93 | 93 | 93 | 93 | 91 | 91 | 93 |
| | Material hardness (Shore D) | 66 | 66 | 66 | 66 | 66 | 66 | 66 | 66 | 64 | 64 | 66 |
| Intermediate layer-encased sphere | Diameter (mm) | 41.35 | 41.35 | 41.35 | 41.75 | 41.05 | 41.35 | 41.35 | 41.05 | 41.35 | 41.05 | 40.80 |
| | Weight (g) | 40.68 | 40.68 | 40.68 | 40.59 | 40.75 | 40.68 | 40.68 | 40.75 | 40.68 | 40.75 | 39.74 |
| | Deflection (mm) | 2.6 | 2.6 | 2.6 | 3.0 | 2.6 | 2.6 | 2.6 | 2.6 | 3.6 | 3.6 | 2.6 |
| | Surface hardness (Shore C) | 98 | 98 | 98 | 98 | 98 | 98 | 98 | 98 | 97 | 97 | 98 |
| | Surface hardness (Shore D) | 72 | 72 | 72 | 72 | 72 | 72 | 72 | 72 | 70 | 70 | 72 |
| Intermediate layer surface hardness − Core surface hardness (Shore C) | | 12 | 12 | 12 | 14 | 12 | 12 | 12 | 12 | 17 | 17 | 12 |
| Cover | Material | No. 4 | No. 4 | No. 4 | No. 4 | No. 4 | No. 4 | No. 4 | No. 4 | No. 4 | No. 4 | No. 3 |
| | Thickness (mm) | 0.83 | 0.83 | 0.83 | 0.83 | 0.83 | 0.83 | 0.83 | 0.83 | 0.83 | 0.83 | 1.10 |
| | Material hardness (Shore C) | 74 | 74 | 74 | 74 | 74 | 74 | 74 | 74 | 74 | 74 | 76 |
| | Material hardness (Shore D) | 48 | 48 | 48 | 48 | 48 | 48 | 48 | 48 | 48 | 48 | 50 |
| Dimples | Type | C | D | E | H | A | B | F | G | D | A | D |
| | Number | 330 | 330 | 330 | 330 | 330 | 330 | 330 | 330 | 330 | 330 | 330 |
| | VR (%) | 0.82 | 0.87 | 0.90 | 0.87 | 0.77 | 0.77 | 0.93 | 0.87 | 0.87 | 0.77 | 0.87 |
| Bail | Diameter (mtn) | 43.0 | 43.0 | 43.0 | 43.4 | 42.7 | 43.0 | 43.0 | 42.7 | 43.0 | 42.7 | 43.0 |
| | Weight (g) | 45.5 | 45.5 | 45.5 | 45.5 | 45.5 | 45.5 | 45.5 | 45.5 | 45.5 | 45.5 | 45.5 |
| | Deflection (mm) | 2.4 | 2.4 | 2.4 | 2.7 | 2.4 | 2.4 | 2.4 | 2.4 | 3.3 | 3.3 | 2.4 |
| | Surface hardness (Shore C) | 87 | 87 | 87 | 87 | 87 | 87 | 87 | 87 | 87 | 87 | 89 |
| | Surface hardness (Shore D) | 60 | 60 | 60 | 60 | 60 | 60 | 60 | 60 | 60 | 60 | 60 |
| | Deformation time t1 (μsec) | 282 | 282 | 282 | 285 | 282 | 282 | 282 | 282 | 290 | 290 | 282 |
| | Deformation time t2 (μsec) | 325 | 325 | 325 | 344 | 325 | 325 | 325 | 325 | 381 | 381 | 325 |
| | Ratio between deformation times (t2/t1) | 1.15 | 1.15 | 1.15 | 1.21 | 1.15 | 1.15 | 1.15 | 1.15 | 1.31 | 1.31 | 1.15 |
| | Sum of deformation times (t1 + t2) (μsec) | 607 | 607 | 607 | 628 | 607 | 607 | 607 | 607 | 671 | 671 | 607 |

TABLE 27-continued

| | Example | | | | Comparative Example | | | | | | |
|---|---|---|---|---|---|---|---|---|---|---|---|
| | 1 | 2 | 3 | 4 | 1 | 2 | 3 | 4 | 5 | 6 | 7 |
| Intermediate layer surface hardness – Ball surface hardness (Shore C) | 11 | 11 | 11 | 11 | 11 | 11 | 11 | 11 | 10 | 10 | 9 |
| Ball deflection (B)/Core deflection (E) | 0.80 | 0.80 | 0.80 | 0.77 | 0.80 | 0.80 | 0.80 | 0.80 | 0.72 | 0.72 | 0.80 |
| Core deflection (E) – Ball deflection (B) (mm) | 0.6 | 0.6 | 0.6 | 0.8 | 0.6 | 0.6 | 0.6 | 0.6 | 1.3 | 1.3 | 0.6 |

The flight performances (W #1 and I #6), spin rate on approach shots and scuff resistance of each golf ball are evaluated by the following methods. The results are shown in Table 8.

Evaluation of Flight (W #1)

A driver (W #1) is mounted on a golf swing robot and the total distances R and Q traveled by the ball when struck at respective head speeds of 55 m/s and 42 m/s are each measured, following which the difference R-Q between these total distances is determined and rated according to the criteria shown below. The club used is the Tour B XD-5 Driver (loft angle, 9.5°) manufactured by Bridgestone Sports Co., Ltd.

Rating Criteria (1)

Good: Distance at HS of 42 m/s (total Q) is at least 204.0 m

NG: Distance at HS of 42 m/s (total Q) is less than 204.0 m

Rating Criteria (2)

Good: Difference in total distance (R−Q) is less than 90.0 m

NG: Difference in total distance (R−Q) is 90.0 m or more

Evaluation of Flight (I #6)

A number six iron (I #6) is mounted on a golf swing robot and the carry and total distance when struck at a head speed of 42 m/s are measured. The run is calculated from these distances and is rated according to the criteria shown below. The club used is the Tour B X-CB I #6 manufactured by Bridgestone Sports Co., Ltd.

Rating Criteria (1)

Good: Total distance is at least 178.0 m

NG: Total distance is less than 178.0 m

Rating Criteria (2)

Good: Run (total−carry) is less than 11.0 m

NG: Run (total−carry) is 11.0 m or more

Evaluation of Spin Rate on Approach Shots

A sand wedge is mounted on a golf swing robot and the amount of spin by the ball when struck at a head speed of 16 m/s is rated according to the criteria shown below. The spin rate is measured with a launch monitor immediately after the ball is struck. The sand wedge used is the Tour B XW-1 SW manufactured by Bridgestone Sports Co., Ltd.

Rating Criteria:

Good: Spin rate is 4,000 rpm or more

NG: Spin rate is less than 4,000 rpm

Scuff Resistance

A PS wedge with square grooves is mounted on a golf swing robot, and the scuff resistance of the ball when struck at a head speed (HS) of 40 m/s is rated according to the following criteria.

Good: The resistance to scuffing is comparable to or better than that of the ball in Example 3

NG: Scuffing is more pronounced than in Example 3

TABLE 8

| | | | Example | | | | Comparative Example | | | | | | |
|---|---|---|---|---|---|---|---|---|---|---|---|---|---|
| | | | 1 | 2 | 3 | 4 | 1 | 2 | 3 | 4 | 5 | 6 | 7 |
| Flight | W#1, HS = 55 m/s | Total distance R (m) | 295.4 | 293.1 | 287.3 | 289.6 | 300.1 | 297.8 | 281.5 | 295.1 | 289.1 | 297.2 | 291.9 |
| | W#1, HS = 42 m/s | Total distance Q (m) | 206.0 | 206.9 | 205.2 | 206.4 | 207.5 | 206.3 | 203.4 | 207.9 | 208.0 | 210.9 | 206.1 |
| | Rating of total Q | | good | good | good | good | good | good | NG | good | good | good | good |
| | R − Q (m) | | 89.4 | 86.2 | 82.1 | 83.2 | 92.6 | 91.4 | 78.0 | 87.2 | 81.1 | 86.3 | 85.8 |
| | Rating of distance difference (R − Q) | | good | good | good | good | NG | NG | good | good | good | good | good |
| Flight | I#6, HS = 42 m/s | Carry (m) | 169.3 | 171.7 | 171.5 | 169.3 | 171.1 | 169.8 | 167.4 | 172.0 | 176.6 | 177.1 | 171.1 |
| | | Total distance (m) | 179.0 | 181.6 | 181.3 | 177.7 | 180.9 | 179.6 | 175.3 | 183.0 | 188.1 | 189.3 | 180.9 |
| | | Rating | good | good | good | good | good | good | NG | good | good | good | good |
| | | Run (m) | 9.8 | 9.9 | 9.9 | 8.4 | 9.9 | 9.8 | 7.9 | 11.0 | 11.6 | 12.2 | 9.8 |
| | | Rating | good | good | good | good | good | good | good | NG | NG | NG | good |
| Approach shots, HS = 16 m/s | | Spin rate (rpm) | 4,509 | 4,509 | 4,509 | 4,419 | 4,509 | 4,509 | 4,509 | 4,240 | 4,240 | 4,240 | 4,410 |
| | | Evaluation | good | good | good | good | good | good | good | good | good | good | good |
| Scuff resistance | | Evaluation | good | good | good | good | good | good | good | good | good | good | NG |

As demonstrated by the results in Table 8, the golf balls of Comparative Examples 1 to 7 are inferior in the following respects to the golf balls according to the present invention that are obtained in Examples 1 to 4.

In Comparative Example 1, the ball diameter is smaller than 42.8 mm and the dimple VR value is smaller than 0.80. As a result, the difference R−Q between the total distance on shots taken at a head speed of 55 m/s and the total distance on shots taken at a head speed of 42 m/s is large.

In Comparative Example 2, the dimple VR value is smaller than 0.80. As a result, the difference R−Q between the total distance on shots taken at a head speed of 55 m/s and the total distance on shots taken at a head speed of 42 m/s is large.

In Comparative Example 3, the dimple VR value is larger than 0.92. As a result, the difference R−Q between the total distance on shots taken at a head speed of 55 m/s and the total distance on shots taken at a head speed of 42 m/s is large.

In Comparative Example 4, the ball diameter is smaller than 42.8 mm and the dimple VR value is smaller than 0.80. As a result, the difference R−Q between the total distance on shots taken at a head speed of 55 m/s and the total distance on shots taken at a head speed of 42 m/s is large.

In Comparative Example 5, the sum of the ball deformation times t1 and t2 (t1+t2) is larger than 660 μsec. As a result, the run on shots with an iron (I #6) increases.

In Comparative Example 6, the ball diameter is smaller than 42.8 mm and the sum of the ball deformation times t1 and t2 (t1+t2) is larger than 660 μsec. As a result, the run on shots with an iron (I #6) increases.

In Comparative Example 7, the cover is formed primarily of an ionomer resin. As a result, the ball surface scuffs easily.

Japanese Patent Application No. 2021-087080 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a core and a cover, which cover has a plurality of dimples on a surface thereof, wherein the cover is formed primarily of polyurethane and the dimples thereon have a volume occupancy ratio VR within the range of 0.80 to 0.92%, the ball has a diameter of at least 42.8 mm and, in an impact test carried out by hitting the ball with a driver at a head speed of 40 m/s, the sum t1+t2 of the time t1 required from initial contact by the driver with the ball for deformation of the ball to reach a maximum and the time t2 required from the state of maximum ball deformation for the ball and the driver to separate is 660 μsec or less, wherein the core has a diameter of at least 37.0 mm and a hardness profile in which, letting Cc be the Shore C hardness at a center of the core, Cs be the Shore C hardness at a surface of the core, Cm be the Shore C hardness at a midpoint M between the core center and the core surface, Cm−2, Cm−4, Cm−6 and Cm−8 be the respective Shore C hardnesses at positions 2 mm, 4 mm, 6 mm and 8 mm inward from the midpoint M and Cm+2, Cm+4 and Cm+6 be the respective Shore C hardnesses at positions 2 mm, 4 mm and 6 mm outward from the midpoint M, and defining surface areas X and A to F as follows surface area X: ½×2×(Cm−6-Cm−8)
surface area A: ½×2×(Cm−4-Cm−6)
surface area B: ½×2×(Cm−2-Cm−4)
surface area C: ½×2×(Cm-Cm−2)
surface area D: ½×2×(Cm+2-Cm)
surface area E: ½×2×(Cm+4-Cm+2)
surface area F: ½×2×(Cm+6-Cm+4), the core satisfies the condition:

(surface area D+surface area E+surface area F)−(surface area A+surface area B+surface area C)>0, and wherein an intermediate layer made of a resin material is formed between the core and the cover, and the sphere obtained by encasing the core with the intermediate layer (intermediate layer-encased sphere) and the ball satisfy the following surface hardness (Shore C hardness) relationship;

9≤(surface hardness of intermediate layer-encased sphere)−(surface hardness of ball)≤15, and the surface hardness of the intermediate layer-encased sphere is from 70 to 78, expressed on the Shore D hardness scale.

2. The golf ball of claim 1, wherein the time t1 and the time t2 have a ratio t2/t1 therebetween which is 1.28 or less.

3. The golf ball of claim 1, wherein the ball has a deflection of 3.2 mm or less when compressed under a final load of 1,275 N (130 kgf) from an initial load of 98 N (10 kgf).

4. The golf ball of claim 1, wherein the core satisfies the condition:

(surface area *D*+surface area *E*+surface area *F*)−(surface area *X*+surface area *A*+surface area *B*+surface area *C*)>0.

5. The golf ball of claim 1, wherein the core satisfies the condition:

(surface area *D*+surface area *E*)−(surface area *A*+surface area *B*+surface area *C*)≥1.

6. The golf ball of claim 1, wherein the core satisfies the condition:

(surface area *D*+surface area *E*)−(surface area *X*+surface area *A*+surface area *B*+surface area *C*)>0.

7. The golf ball of claim 1, wherein the core satisfies the condition:

0<[(surface areas *D*+*E*+*F*)−(surface areas *A*+*B*+*C*)]/(*Cs*−*Cc*)≤1.00.

8. The golf ball of claim 1, wherein the value expressed as Cs−Cc is 20 or more.

9. The golf ball of claim 1 wherein, letting E (mm) be the deflection of the core when compressed under a final load of 1,275 N (130 kgf) from an initial load of 98 N (10 kgf) and B (mm) be the deflection of the ball when compressed under a final load of 1,275 N (130 kgf) from an initial load of 98 N (10 kgf), the value E−B (mm) is from 0.3 to 1.2 mm.

10. A golf ball comprising a core and a cover, which cover has a plurality of dimples on a surface thereof, wherein the cover is formed primarily of polyurethane and the dimples thereon have a volume occupancy ratio VR within the range of 0.80 to 0.92%, the ball has a diameter of at least 42.9 mm and, in an impact test carried out by hitting the ball with a driver at a head speed of 40 m/s, the sum t1+t2 of the time t1 required from initial contact by the driver with the ball for deformation of the ball to reach a maximum and the time t2 required from the state of maximum ball deformation for the ball and the driver to separate is 660 μsec or less, wherein the core has a diameter of at least 37.0 mm and a hardness profile in which, letting Cc be the Shore C hardness at a center of the core, Cs be the Shore C hardness at a surface of the core, Cm be the Shore C hardness at a midpoint M between the core center and the core surface, Cm−2, Cm−4, Cm−6 and Cm−8 be the respective Shore C hardnesses at positions 2 mm, 4 mm, 6 mm and 8 mm inward from the midpoint M and Cm+2, Cm+4 and Cm+6 be the respective Shore C hardnesses at positions 2 mm, 4 mm and 6 mm outward from the midpoint M, and defining surface areas X and A to F as follows surface area X: ½×2×(Cm−6-Cm−8)
surface area A: ½×2×(Cm−4-Cm−6)
surface area B: ½×2×(Cm−2-Cm−4)
surface area C: ½×2×(Cm-Cm−2)
surface area D: ½×2×(Cm+2-Cm)

surface area E: ½×2×(Cm+4-Cm+2)
surface area F: ½×2×(Cm+6-Cm+4),
the core satisfies the condition:

(surface area *D*+surface area *E*+surface area *F*)−(surface area *A*+surface area *B*+surface area *C*)>0.

* * * * *